US011189967B2

(12) United States Patent
Yang et al.

(10) Patent No.: US 11,189,967 B2
(45) Date of Patent: Nov. 30, 2021

(54) ELECTRICAL CONNECTOR AND CONNECTOR ASSEMBLY HAVING THE SAME

(71) Applicant: LOTES CO., LTD, Keelung (TW)

(72) Inventors: Qi Xiao Yang, Keelung (TW); Wen Chang Chang, Keelung (TW); Yan Chun Wen, Keelung (TW); Chu Jun Liang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/034,390

(22) Filed: Sep. 28, 2020

(65) Prior Publication Data

US 2021/0344141 A1 Nov. 4, 2021

(30) Foreign Application Priority Data

Apr. 29, 2020 (CN) ..... 202010357396.0

(51) Int. Cl.

| | |
|---|---|
| ***H01R 13/629*** | (2006.01) |
| ***H01R 12/70*** | (2011.01) |
| ***H01R 13/08*** | (2006.01) |
| ***H01R 13/639*** | (2006.01) |
| ***H01R 13/627*** | (2006.01) |

(Continued)

(52) U.S. Cl.

CPC ..... *H01R 13/629* (2013.01); *H01R 12/7005* (2013.01); *H01R 13/08* (2013.01); *H01R 13/10* (2013.01); *H01R 13/40* (2013.01); *H01R 13/6272* (2013.01); *H01R 13/639* (2013.01)

(58) Field of Classification Search

CPC .. H01R 13/629; H01R 12/7005; H01R 13/08; H01R 13/10; H01R 13/40; H01R 13/6272; H01R 13/639; H01R 13/6273

See application file for complete search history.

(56) References Cited

U.S. PATENT DOCUMENTS 6,123,575 A * 9/2000 Huang ..... H01R 13/6273 439/352
6,257,925 B1 * 7/2001 Jones ..... H01R 13/6273 439/357

(Continued)

FOREIGN PATENT DOCUMENTS

CN 203850471 U 9/2014
CN 210111175 U 2/2020

*Primary Examiner* — Tho D Ta

(74) *Attorney, Agent, or Firm* — Locke Lord LLP; Tim Tingkang Xia, Esq.

(57) ABSTRACT

An electrical connector includes an insulating seat and at least one conductive terminal provided therein. The insulating seat includes a rear wall and two side walls, surroundingly forming a mating space. Each side wall includes an extending arm and an elastic arm. The elastic arm has a first arm extending forward from the extending arm and a second arm bending reversely from the first arm and extending backward. The second arm is connected to the rear wall. An opening slot is formed between the first arm and the extending arm and runs forward therethrough. A through slot is formed between the second arm and the first arm. A buckling portion is formed at a side of the second arm away from the first arm to correspond to the through slot and the opening slot in a left-right direction. The conductive terminal has a contact portion exposed to the mating space.

30 Claims, 21 Drawing Sheets

(51) Int. Cl.
*H01R 13/40* (2006.01)
*H01R 13/10* (2006.01)

(56) References Cited

U.S. PATENT DOCUMENTS

| | | | | |
|---|---|---|---|---|
| 6,517,372 | B1 * | 2/2003 | Jones | H01R 4/26 439/159 |
| 2009/0119890 | A1 * | 5/2009 | Laruccia | A45C 13/1084 24/586.1 |
| 2018/0040977 | A1 * | 2/2018 | Zhao | H01R 13/6273 |
| 2020/0112110 | A1 * | 4/2020 | Arai | H01R 13/629 |

* cited by examiner

E-E

ELECTRICAL CONNECTOR AND CONNECTOR ASSEMBLY HAVING THE SAME

CROSS-REFERENCE TO RELATED PATENT APPLICATION

This non-provisional application claims priority to and the benefit of, pursuant to 35 U.S.C. § 119(a), patent application Serial No. CN202010357396.0 filed in China on Apr. 29, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a connector assembly having the same, and particularly to an electrical connector locked with a mating connector by elastic arms.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing connector assembly includes an electrical connector and a mating connector to be mated thereto. The electrical connector includes an insulating seat, a plurality of conductive terminals provided in the insulating seat, and two metal fixing members. The insulating seat is provided with a rear wall and two side walls connected to a left side and a right side of the rear wall, and an insertion space is provided between the rear wall and the two side walls. The conductive terminals are provided on the rear wall and exposed to the insertion space. Each side wall is provided with a fixing arm and an elastic arm provided close to the insertion space relative to the fixing arm. Each metal fixing member is in interference fit with one of the fixing arms, and is downward soldered to a circuit board. The elastic arm is formed by extending backward from a front end of the fixing arm, and a back end of the elastic arm is connected to the rear wall. A through slot is formed between the elastic arm and the fixing arm. A buckling portion is provided on the elastic arm, and the buckling portion is provided corresponding to the through slot. The mating connector is inserted backward into the insertion space. The mating connector is provided with an insulating body and a plurality of mating terminals provided in the insulating body. Two clamping portions are respectively provided at a left side and a right side of the insulating body. The mating terminals and the conductive terminals are conductively connected. The buckling portions are correspondingly buckled to the clamping portions to lock the mating connector and the electrical connector, thus facilitating the signal transmission.

Since the elastic arm is an arm connected to the front end of the fixing arm and the rear wall, the elastic arm is short, resulting in weak elasticity and strong strength thereof. The mating connector needs to overcome a greater interfering force, such that the buckling portions passes beyond the clamping portions to lock each other. Thus, the elastic arm may easily fatigue, affecting the life of the elastic arm, and failing to meet the requirement of the insertion number of the electrical connector and the mating connector.

Therefore, a heretofore unaddressed need to design a novel electrical connector and a connector assembly having the same exists in the art to address the aforementioned deficiencies and inadequacies.

SUMMARY

In view of the deficiency of the background, the present invention is directed to an electrical connector and a connector assembly having the same, in which the length of the elastic arm is increased to ensure its elasticity.

To achieve the foregoing objective, the present invention adopts the following technical solutions.

An electrical connector includes: an insulating seat, comprising a rear wall and two side walls located at a left side and a right side of the rear wall, wherein the rear wall and the two side walls surroundingly form a mating space, each of the two side walls comprises an extending arm and an elastic arm provided close to the mating space relative to the extending arm, the elastic arm has a first arm formed by extending forward from the extending arm and a second arm formed by bending reversely from the first arm and extending backward, the second arm is backward connected to the rear wall, an opening slot is formed between the first arm and the extending arm and runs forward therethrough, a through slot is formed between the second arm and the first arm, a buckling portion is formed at a side of the second arm away from the first arm, and the buckling portion is provided to correspond to the through slot and the opening slot in a left-right direction; and at least one conductive terminal, provided in the insulating seat, wherein the conductive terminal has a contact portion exposed to the mating space.

In certain embodiments, the through slot extends backward to pass beyond the opening slot.

In certain embodiments, a back end of the opening slot is located in front of the rear wall.

In certain embodiments, a distance between the buckling portion and a front end surface of a corresponding side wall of the two side walls is less than a distance between the buckling portion and a front end surface of the rear wall.

In certain embodiments, the opening slot comprises a first slot and a second slot connected to a back end of the first slot, the first slot runs forward through a corresponding side wall of the two side walls, and a width of a front end of the first slot in a left-right direction is greater than a width of the back end of the first slot in the left-right direction.

In certain embodiments, the second arm is provided with a guiding chamfer connected to a front end surface of the second arm and facing the mating space, the first arm is provided with an oblique surface connected to a front end surface of the first arm and facing the opening slot, and a back end of the oblique surface passes backward beyond the guiding chamfer.

In certain embodiments, the through slot comprises a front through slot and a rear through slot, a width of the front through slot in a left-right direction is greater than a width of the rear through slot in the left-right direction, and the buckling portion is provided to correspond to the front through slot in the left-right direction.

In certain embodiments, the extending arm of each of the two side walls is fixed with a fixing member, the fixing member is provided with a retaining portion and a mounting portion, the retaining portion is fixed with interference to a corresponding side wall of the two side walls at a location behind the opening slot, and the mounting portion is configured to be mounted on a circuit board.

In certain embodiments, the fixing member protrudes backward to pass beyond a front end surface of the rear wall.

In certain embodiments, the extending arm of each of the two side walls is fixed with a fixing member, the fixing member is configured to be fixed to a circuit board, and a side of the fixing member is exposed to the opening slot of a corresponding side wall of the two side walls.

In certain embodiments, the insulating seat further comprises a top wall connected to the rear wall, the top wall is located above the mating space, two grooves are backward concavely provided on a left side and a right side of a front end of the top wall respectively, each of the two grooves is provided to be adjacent to the second arm of a corresponding side wall of the two side walls, and a back end of each of the two grooves is located behind the buckling portion of the corresponding side wall.

In certain embodiments, each of the two grooves has a side edge provided at an interval with the second arm of the corresponding side wall in a left-right direction, the buckling portion is formed by protruding from the second arm toward the mating space, and the buckling portion does not pass beyond the side edge of a corresponding groove of the two grooves in the left-right direction.

A connector assembly includes: an electrical connector, comprising an insulating seat and at least one conductive terminal provided in the insulating seat, wherein the insulating seat comprises a rear wall and two side walls located at a left side and a right side of the rear wall, the rear wall and the two side walls surroundingly form a mating space, each of the two side walls comprises an extending arm and an elastic arm provided close to the mating space relative to the extending arm, the elastic arm has a first arm extending forward from the extending arm and a second arm bending reversely from the first arm and extending backward, the second arm is backward connected to the rear wall, an opening slot is formed between the first arm and the extending arm and runs forward therethrough, a through slot is formed between the second arm and the first arm, a buckling portion is formed at a side of the second arm away from the first arm, the buckling portion is provided to correspond to the through slot and the opening slot in a left-right direction, and the conductive terminal has a contact portion exposed to the mating space; and a mating connector, inserted backward into the mating space of the electrical connector, wherein the mating connector comprises an insulating body and at least one mating terminal accommodated in the insulating body, two clamping portions are respectively provided at a left side and a right side of the insulating body to correspondingly buckle with the buckling portions provided on the two side walls, and the mating terminal is provided with a mating portion to be conductively connected to the contact portion.

In certain embodiments, the through slot extends backward to pass beyond the opening slot.

In certain embodiments, a distance between the buckling portion and a front end surface of a corresponding side wall of the two side walls is less than a distance between the buckling portion and a front end surface of the rear wall.

In certain embodiments, the opening slot comprises a first slot and a second slot connected to a back end of the first slot, the first slot runs forward through a corresponding side wall of the two side walls, and a width of a front end of the first slot in a left-right direction is greater than a width of the back end of the first slot in the left-right direction.

In certain embodiments, the extending arm of each of the two side walls is fixed with a fixing member, the fixing member is provided with a retaining portion and a mounting portion, the retaining portion is fixed with interference to a corresponding side wall of the two side walls at a location behind the opening slot, and the mounting portion is configured to be mounted on a circuit board.

In certain embodiments, the insulating seat further comprises a top wall connected to the rear wall, the top wall is located above the mating space, two grooves are backward concavely provided on a left side and a right side of a front end of the top wall respectively, each of the two grooves is provided to be adjacent to the second arm of a corresponding side wall of the two side walls, each of the clamping portions is located behind the corresponding buckling portion, and each of the clamping portions is exposed to a corresponding groove of the two grooves.

In certain embodiments, the insulating body is provided with a main body portion and a locking arm, and the two clamping portions are respectively provided at a left side and a right side of the main body portion; the locking arm is provided with a first elastic arm formed by extending upward and backward from a top surface of the main body portion and a second elastic arm formed by extending forward from the first elastic arm, the second elastic arm is located above the first elastic arm, a front end of the second elastic arm passes forward beyond the first elastic arm, and a separation slot is formed between the first elastic arm and the second elastic arm; the first elastic arm is provided with a locking portion facing downward to lock a clip portion of the electrical connector; the second elastic arm is provided with a first stopping portion located in front of the locking portion and a second stopping portion located in front of the first stopping portion; the locking arm is provided with a pressing portion on the second arm, when an acting force is provided to press the pressing portion downward, the locking portion moves upward, and the first stopping portion downward abuts the first elastic arm prior to the second stopping portion downward abutting the top surface of the main body portion; after the first stopping portion downward abuts the first elastic arm, the acting force is continuously provided to press the pressing portion downward, such that the locking portion continues moving upward, and the locking portion and the clip portion detach from each other, and the second stopping portion downward abuts the top surface of the main body portion to suppress the second elastic arm from being excessively pressed downward.

In certain embodiments, the locking portion and the second stopping portion are both located below the first stopping portion.

In certain embodiments, the pressing portion is formed by protruding upward from a front end of the second elastic arm, a protrusion portion is formed by protruding downward from the second elastic arm, the second stopping portion is formed at a bottom end of the protrusion portion, and the pressing portion and the second stopping portion are provided to align vertically.

In certain embodiments, the main body portion is provided with at least accommodating hole accommodating the at least one mating terminal and at least one through hole running through the top surface of the main body portion, the at least one accommodating hole runs through the main body portion in a front-rear direction, the through hole is in communication with a corresponding one of the at least one accommodating hole, the mating terminal is provided with a blocking portion, the blocking portion protrudes into the through hole to prevent the mating terminal from retreating from the accommodating hole, and a front end surface of the second arm is located behind the through hole.

In certain embodiments, two reserved slots are provided at the left side and the right side of the main body portion and correspond to the two clamping portions, the reserved slots provide deformation spaces for the corresponding clamping portions, and each of the reserved slots is in communication with a corresponding one of the at least one through hole.

In certain embodiments, the insulating body is provided with at least one accommodating hole correspondingly accommodating the at least one mating terminal and at least one protruding block corresponding to the at least one accommodating hole, the protruding block is located in front of a corresponding conductive terminal of the at least one conductive terminal to limit the corresponding conductive terminal from being excessively inserted forward into a corresponding one of the at least one accommodating hole.

In certain embodiments, two guiding portions are respectively provided at the left side and the right side of the insulating body and located below the two clamping portions correspondingly, the two guiding portions pass forward and backward beyond the two clamping portions correspondingly, and in a process of the electrically connector mating with the mating connector, the guiding portions are located below the two buckling portions and guide the insulating body to be inserted backward into the mating space.

In certain embodiments, the insulating seat is provided with a top wall formed by protruding forward from the rear wall, the top wall is located above the mating space, a recess is backward concavely provided on a front end of the top wall, the top wall is provided with two clip portions located at a left side and a right side of the recess, the insulating body is provided with a main body portion and a locking arm formed by extending from a top surface of the main body portion, the locking arm is accommodated in the recess, two locking portions are formed by respectively protruding from a left side and a right side of a front end of the locking arm, the two locking portions are respectively located behind the two clip portions correspondingly such that the locking portions and the clip portions are correspondingly locked to each other, a pressing portion is formed by protruding upward from the front end of the locking arm, and the pressing portion is located between the two locking portions and aligned to the two locking portions in the left-right direction.

In certain embodiments, a top surface of the pressing portion is higher than a top surface of each of the two clip portions.

In certain embodiments, the locking arm comprises a first elastic arm formed by extending upward and backward from a top surface of the main body portion and a second elastic arm formed by extending forward from the first elastic arm, the second elastic arm is located above the first elastic arm, the locking portions are formed by protruding from a front end of the second elastic arm in the left-right direction, and the locking portions are located in front of the first arm.

In certain embodiments, a top surface of each of the locking portions is provided to be flush with a top surface of the second elastic arm.

In certain embodiments, each of the clip portions is provided with a first guiding chamfer facing downward, the first guiding chamfer is provided obliquely backward and downward from a front end surface of each of the clip portions, each of the locking portions is provided with a second guiding chamfer facing upward, the second guiding chamfer is provided obliquely forward and upward from a back end surface of each of the locking portions, the second guiding chamfer is guided by the first guiding chamfer, such that each of the locking portions moves to be behind a corresponding one of the clip portions.

Compared with the related art, the electrical connector and the connector assembly having the same according to certain embodiments of the present invention have the following beneficial effects.

The elastic arm has the first arm extending forward from the extending arm and the second arm bending reversely from the first arm and extending backward. The second arm is backward connected to the rear wall. The opening slot is formed between the first arm and the extending arm and runs forward therethrough. The through slot is formed between the second arm and the first arm. The buckling portion is formed at a side of the second arm away from the first arm. The buckling portion is provided to correspond to the through slot and the opening slot in the left-right direction. By the n-shaped structure of the elastic arm, the overall length of the elastic arm for deformation is increased, such that the elasticity of the elastic arm becomes better, thus increasing the insertion number of the electrical connector and the mating connector, satisfying the usage requirement, increasing the usage life of the elastic arm, and saving the machining cost.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
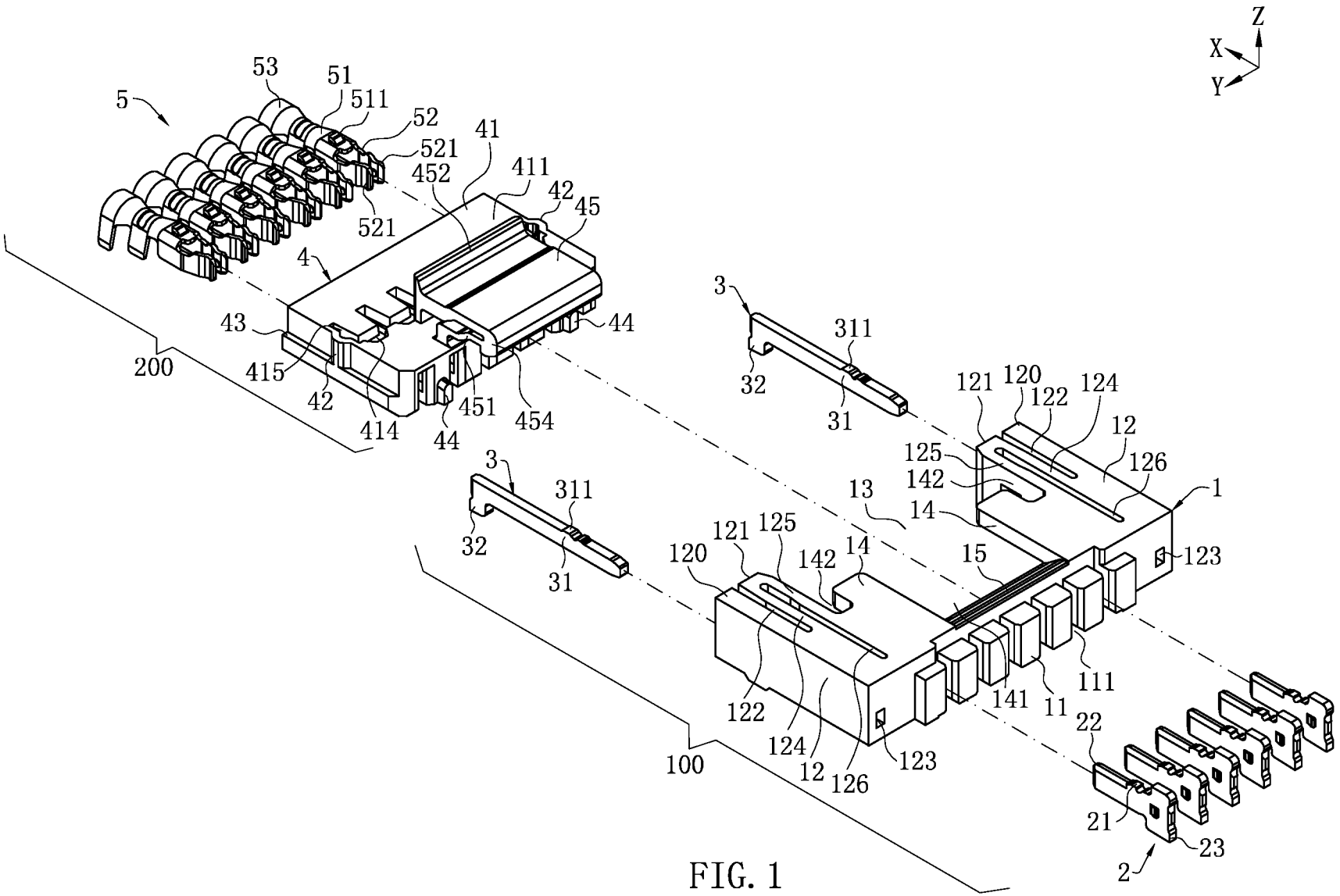
FIG. 1 is a perspective exploded view of an electrical connector and a connector assembly having the same according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-21. In accordance with the purposes of this invention, as embodied and broadly described herein, this invention, in one aspect, relates to an electrical connector and a connector assembly having the same.

Figure 12:
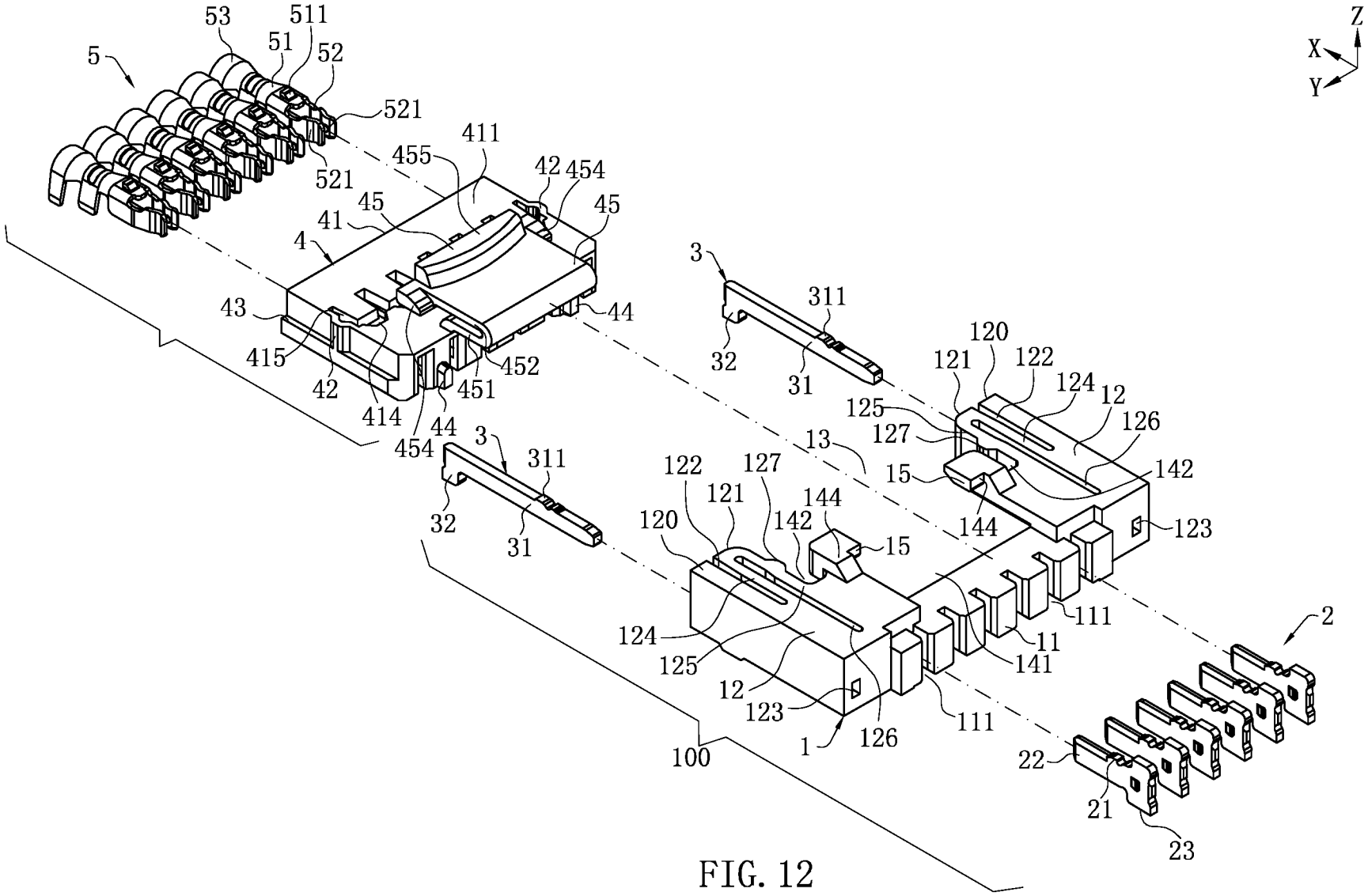
FIG. 12 is a perspective exploded view of an electrical connector and a connector assembly having the same according to a second embodiment of the present invention.
Figure 13:
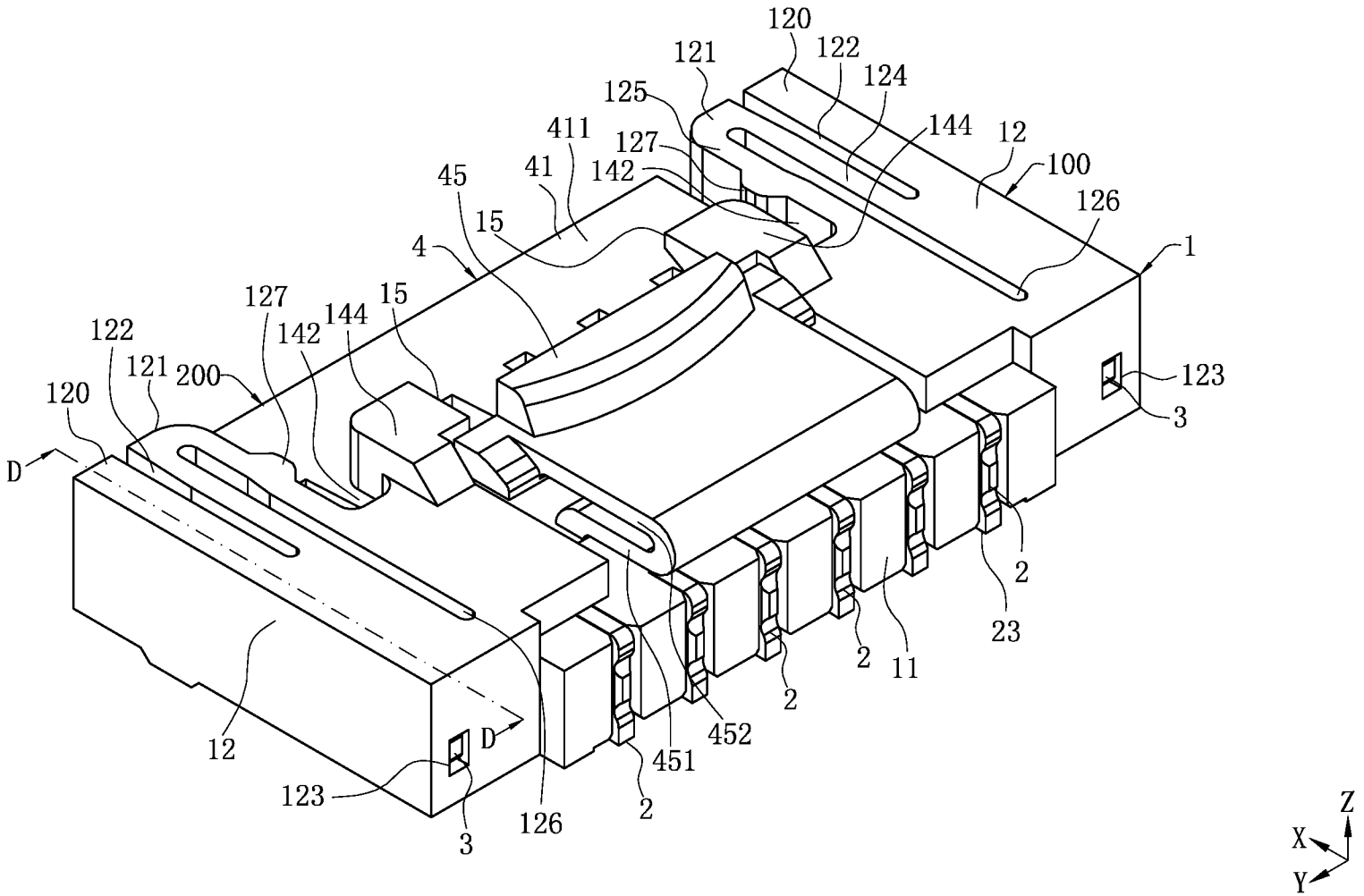
FIG. 13 is a perspective assembled view of FIG. 12.

As shown in FIG. 1 and FIG. 12, in an electrical connector 100 and a connector assembly having the same according to certain embodiments of the present invention, a forward direction in a front-rear direction is defined as the positive direction of the X-axis, a leftward direction in a left-right direction is defined as the positive direction of the Y-axis, and an upward direction in a vertical direction is defined as the positive direction of the Z-axis.

FIG. 1 to FIG. 11 show an electrical connector 100 and a connector assembly having the electrical connector 100 according to a first embodiment of the present invention. The connector assembly includes an electrical connector 100 and a mating connector 200. The electrical connector 100 is downward mounted onto a circuit board 300. The mating connector 200 is used to be electrically connected to a cable (not shown).

Figure 3:
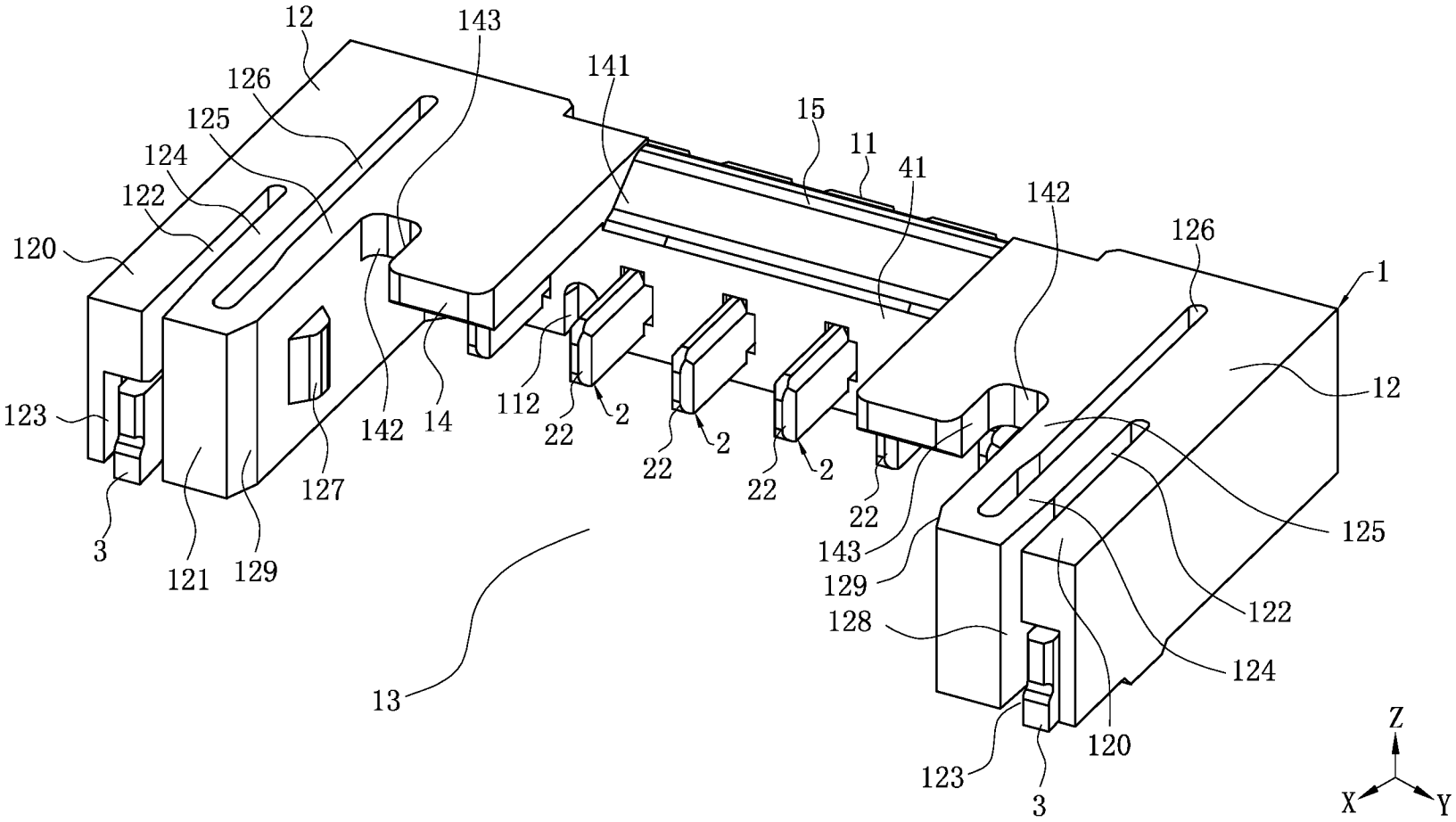
FIG. 3 is a perspective view of the electrical connector in FIG. 2 from another viewing angle.

As shown in FIG. 1 and FIG. 3, the electrical connector 100 includes an insulating seat 1, a plurality of conductive terminals 2 accommodated in the insulating seat 1, and two fixing members 3. In other embodiments, it is possible to provide only one conductive terminal 2.

As shown in FIG. 1 and FIG. 3, the insulating seat 1 includes a rear wall 11 and two side walls 12 located at a left side and a right side of the rear wall 11. The two side walls 12 are connected to the rear wall 11, and the rear wall 11 and the two side walls 12 surroundingly form a mating space 13. The insulating seat 1 further includes a top wall 14 connected to the rear wall 11. The top wall 14 is connected to the two side walls 12 in the left-right direction, and the top wall 14 is located above the mating space 13.

Figure 9:
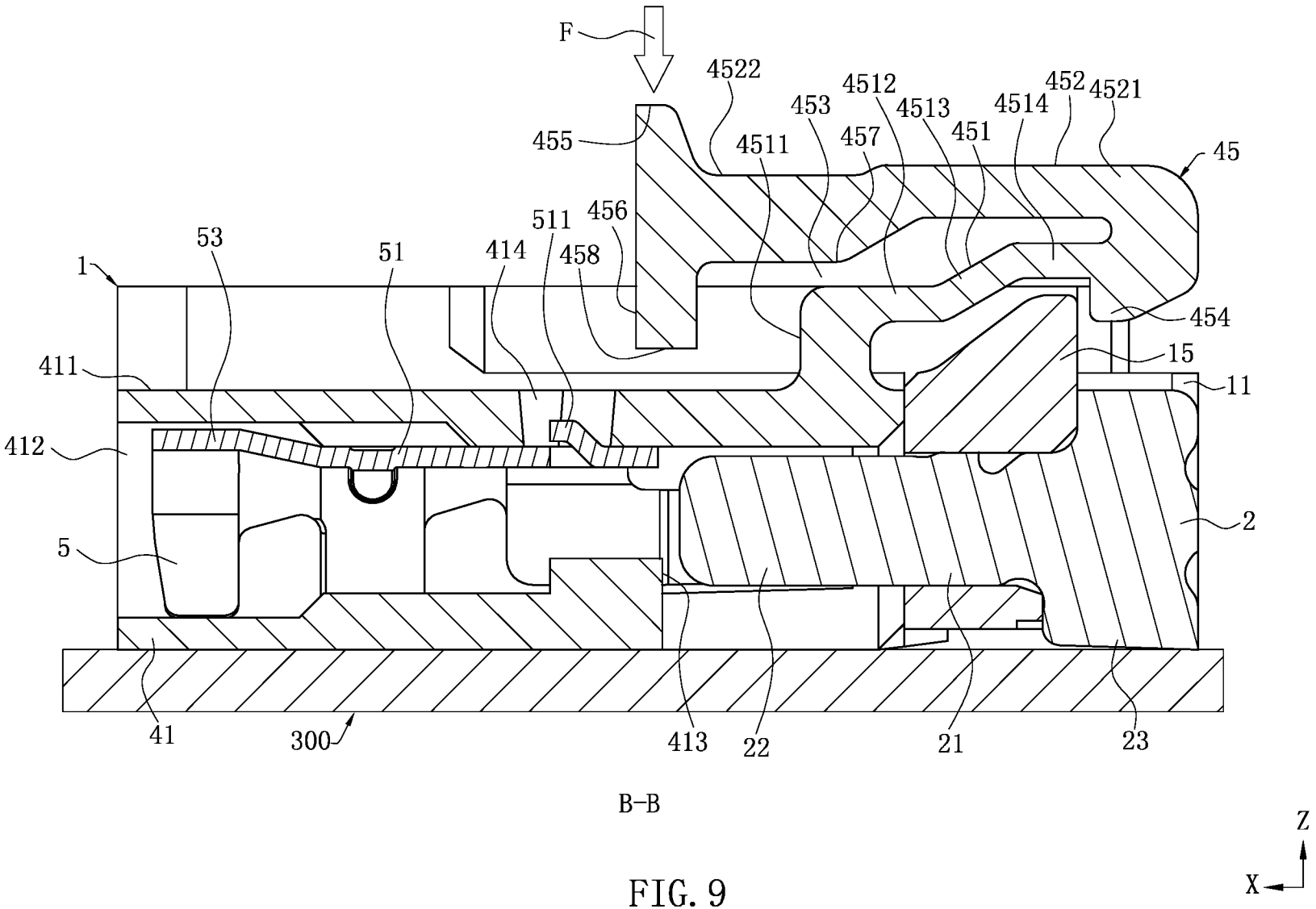
FIG. 9 is a sectional view of the connector assembly and the circuit board in FIG. 4 sectioned along a line B-B.

As shown in FIG. 1, FIG. 3 and FIG. 9, the rear wall 11 is provided with a plurality of terminal holes 111 and a plurality of positioning slots 112. The terminal holes 111 run through the rear wall 11 in the front-rear direction. Each positioning slot 112 is formed by being backward concavely provided on a front end surface of the rear wall 11. Each positioning slot 112 runs downward through a bottom surface of the rear wall 11 but does not run backward through a back end surface of the rear wall 11. Two positioning slots 112 are provided. The positioning slots 112 and the terminal holes 111 are provided to be staggered in the left-right direction. The two positioning slots 112 are substantially located at a left side and a right side of the rear wall 11. The rear wall 11 further includes a clip portion 15. The clip portion 15 is a plastic portion remained by being forward concavely provided on the back end surface of the rear wall 11 and does not run through the front end surface of the rear wall 11. The clip portion 15 is located above the terminal holes 111.

Figure 4:
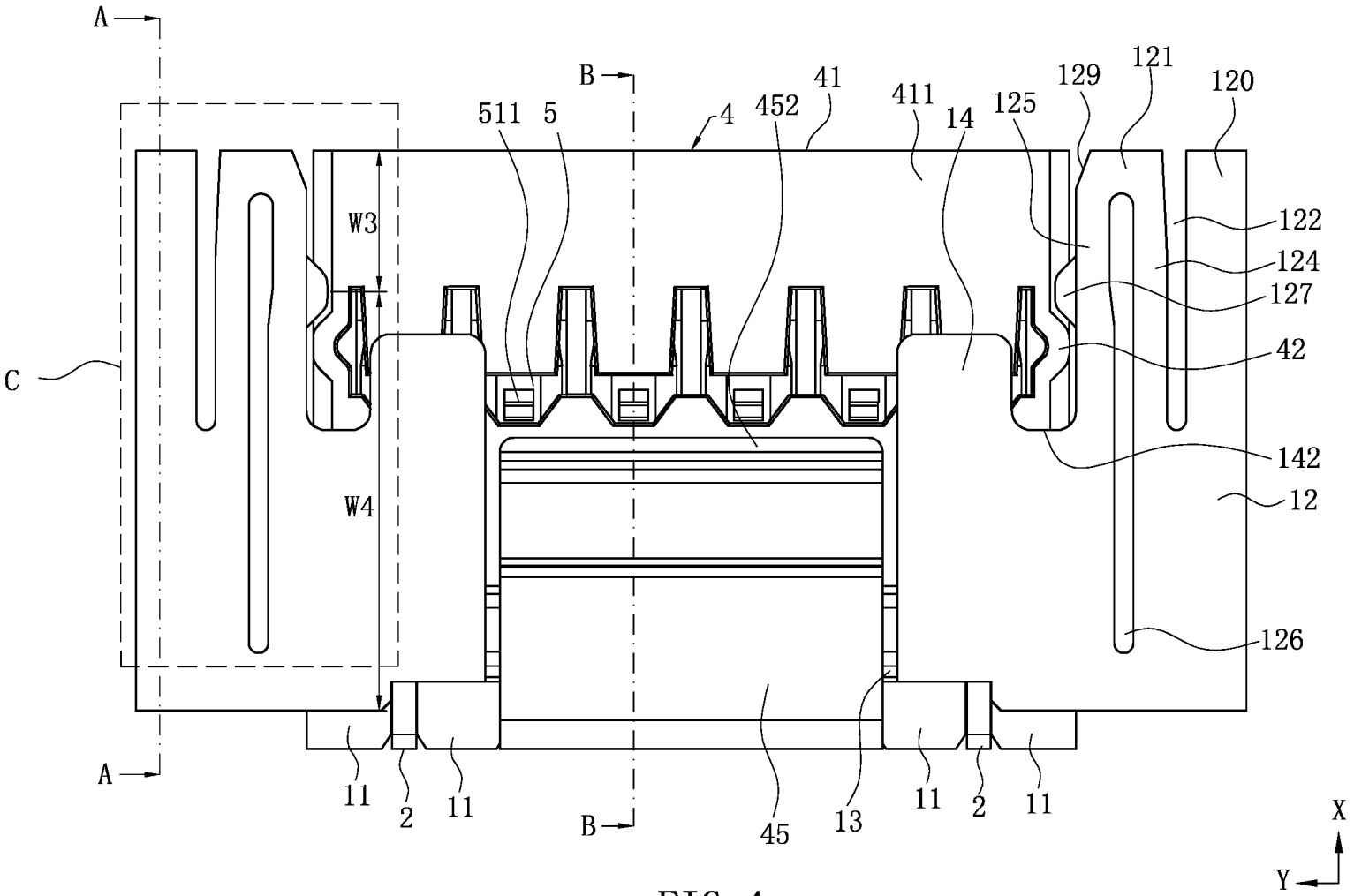
FIG. 4 is a top view of FIG. 2.

As shown in FIG. 3 and FIG. 4, each side wall 12 is provided with an extending arm 120 and an elastic arm 121 provided close to the mating space 13 relative to the extending arm 120. An opening slot 122 is formed between the elastic arm 121 and the extending arm 120. The opening slot 122 extends along the front-rear direction and runs forward through the corresponding side wall 12, and the opening slot 122 simultaneously runs vertically through the corresponding side wall 12.

Figure 2:
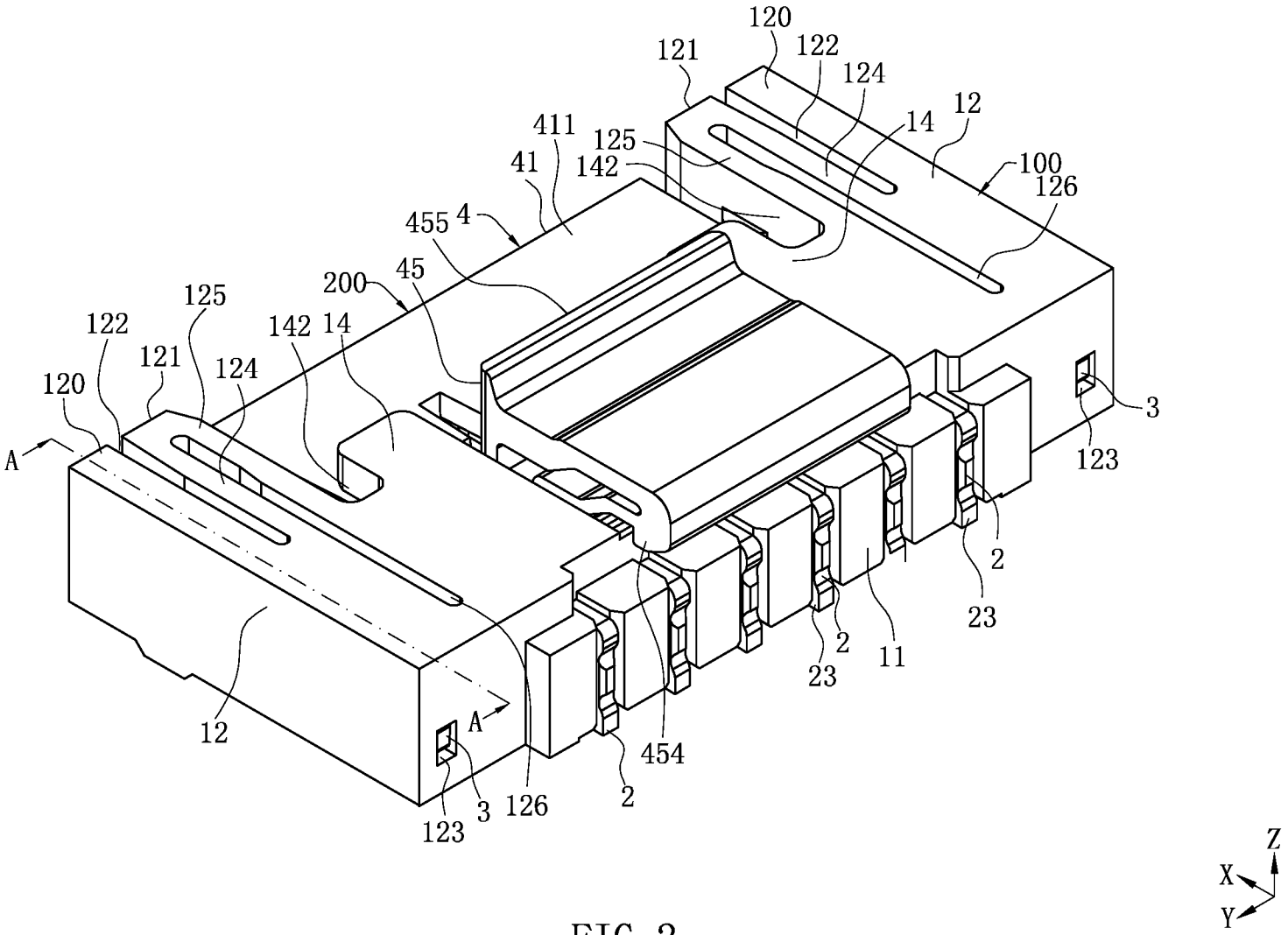
FIG. 2 is a perspective assembled view of FIG. 1.

As shown in FIG. 2 and FIG. 3, each extending arm 120 is provided with a fixing slot 123. The fixing slot 123 is in communication with the opening slot 122 in the left-right direction. The fixing slot 123 runs through the corresponding side wall 12 in the front-rear direction.

As shown in FIG. 3 and FIG. 4, the elastic arm 121 has a first arm 124 formed by extending forward from the extending arm 120 and a second arm 125 formed by bending reversely from the first arm 124 and extending backward. The second arm 125 is backward connected to the rear wall 11. The second arm 125 is provided to be close to the mating space 13 relative to the first arm 124 in the left-right direction.

Figure 5:
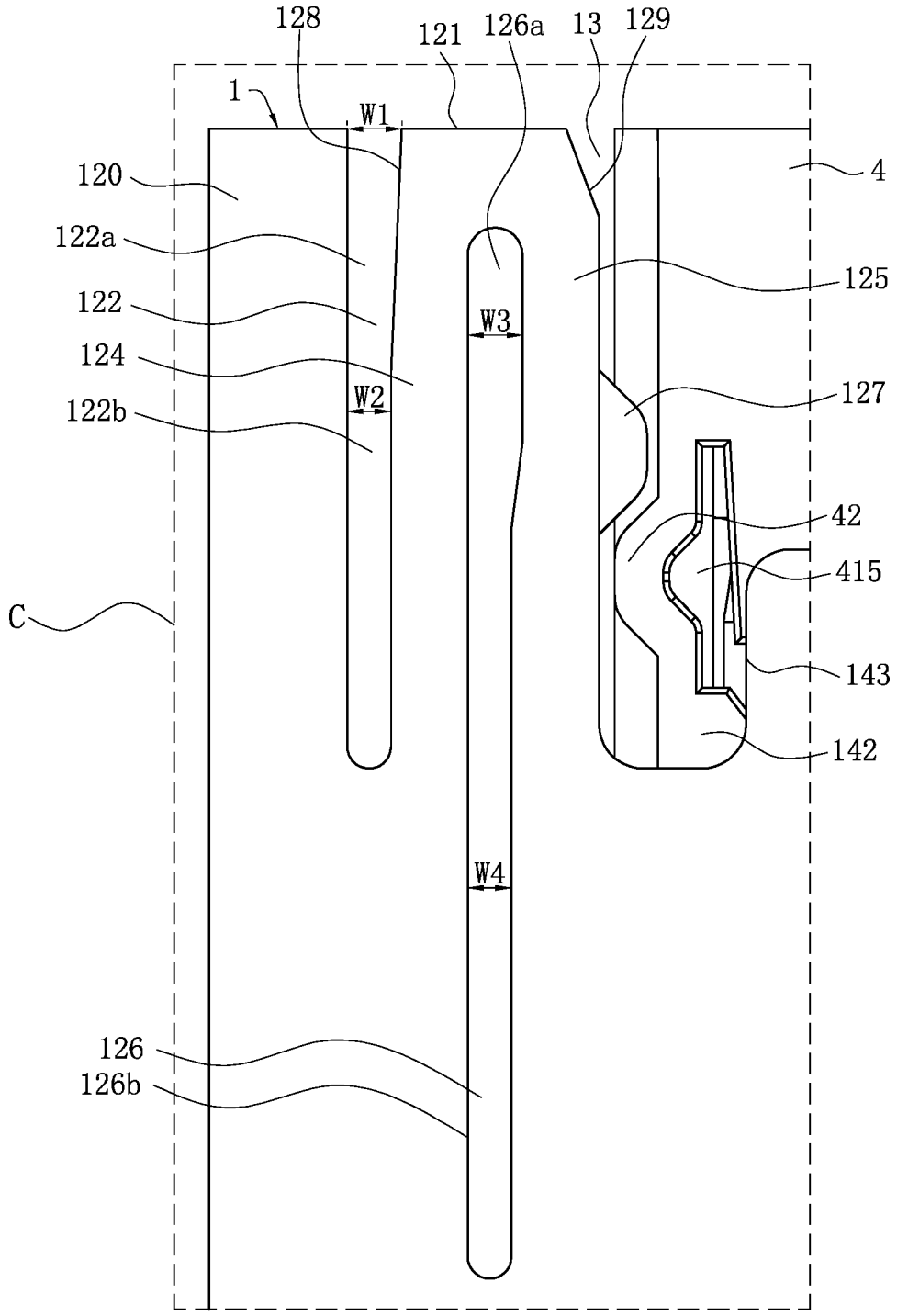
FIG. 5 is an enlarged view of a part C in FIG. 4.
Figure 5:
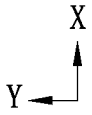

As shown in FIG. 3, FIG. 4 and FIG. 5, the opening slot 122 is formed between the first arm 124 and the extending arm 120. The opening slot 122 includes a first slot 122*a* and a second slot 122*b* connected to a back end of the first slot 122*a*. The first slot 122*a* runs forward through the corresponding side wall 12. A width W1 of a front end of the first slot 122*a* in the left-right direction is greater than a width W2 of the back end of the first slot 122*a* in the left-right direction. A back end of the second slot 122*b* is located in front of the rear wall 11. The first arm 124 is provided with an oblique surface 128 connected to a front end surface of the first arm 124 and facing the opening slot 122. The oblique surface 128 is provided to correspond to the first slot 122*a*.

As shown in FIG. 3, FIG. 4 and FIG. 5, the second arm 125 and the first arm 124 are provided in parallel, and a through slot 126 is formed therebetween. The through slot 126 extends backward to pass beyond the opening slot 122 but does not run backward through the rear wall 11. The through slot 126 runs vertically through the corresponding side wall 12. The through slot 126 includes a front through slot 126*a* and a rear through slot 126*b*. A width W3 of the front through slot 126*a* in the left-right direction is greater than a width W4 of the rear through slot 126*b* in the left-right direction. A buckling portion 127 is formed at a side of the second arm 125 away from the first arm 124. The buckling portion 127 is formed by protruding from the second arm 125 toward the mating space 13. A distance between the buckling portion 127 and the front end surface of the corresponding side wall 12 is less than a distance between the buckling portion 127 and the front end surface of the rear wall 11. The buckling portion 127 is located in front of the front end of the top wall 14, and the buckling portion 127 is provided to correspond to the front through slot 126*a* and the opening slot 122 in the left-right direction. The second arm 125 is further provided with a guiding chamfer 129 connected to the front end surface of the second arm 125 and facing the mating space 13. A back end of the oblique surface 128 passes backward beyond the guiding chamfer 129.

As shown in FIG. 3, FIG. 4 and FIG. 5, a recess 141 and two grooves 142 are backward concavely provided on the front end of the top wall 14. The recess 141 is located between the two grooves 142 in the left-right direction, and the three are provided separately. The recess 141 and the mating space 13 are provided to be in communication in the vertical direction, and the recess 141 is located right in front of the clip portion 15. A width of each groove 142 in the left-right direction is less than that of the recess 141. The recess 141 extends backward to the rear wall 11, and each groove 142 does not extend backward to the rear wall 11. That is, a back end of each groove 142 is located in front of the recess 141. Thus, the recess 141 divides the top wall 14 into two portions. The back end of each groove 142 and the back end of the second slot 122*b* are flush in the front-rear direction. Each groove 142 and a corresponding second arm 125 are provided to be adjacent. The back end of each groove 142 is located behind a corresponding buckling portion 127. Each groove 142 is provided with a side edge 143 in the left-right direction, and the corresponding buckling portion 127 does not pass beyond the side edge 143 of the corresponding groove 142 in the left-right direction.

As shown in FIG. 1, FIG. 3 and FIG. 9, each conductive terminal 2 is formed by blanking from a metal plate. The conductive terminals 2 are one-to-one correspondingly accommodated in the terminal holes 111. Each conductive terminal 2 is provided with a fixing portion 21, a contact portion 22 extending forward from the fixing portion 21 and a soldering portion 23 extending backward from the fixing portion 21. The fixing portion 21 is fixed to a corresponding terminal hole 111 in the vertical direction. The contact portion 22 protrudes forward into the mating space 13. The soldering portion 23 protrudes downward out of a bottom surface of the insulating seat 1 to be soldered to the circuit board 300.

Figure 6:
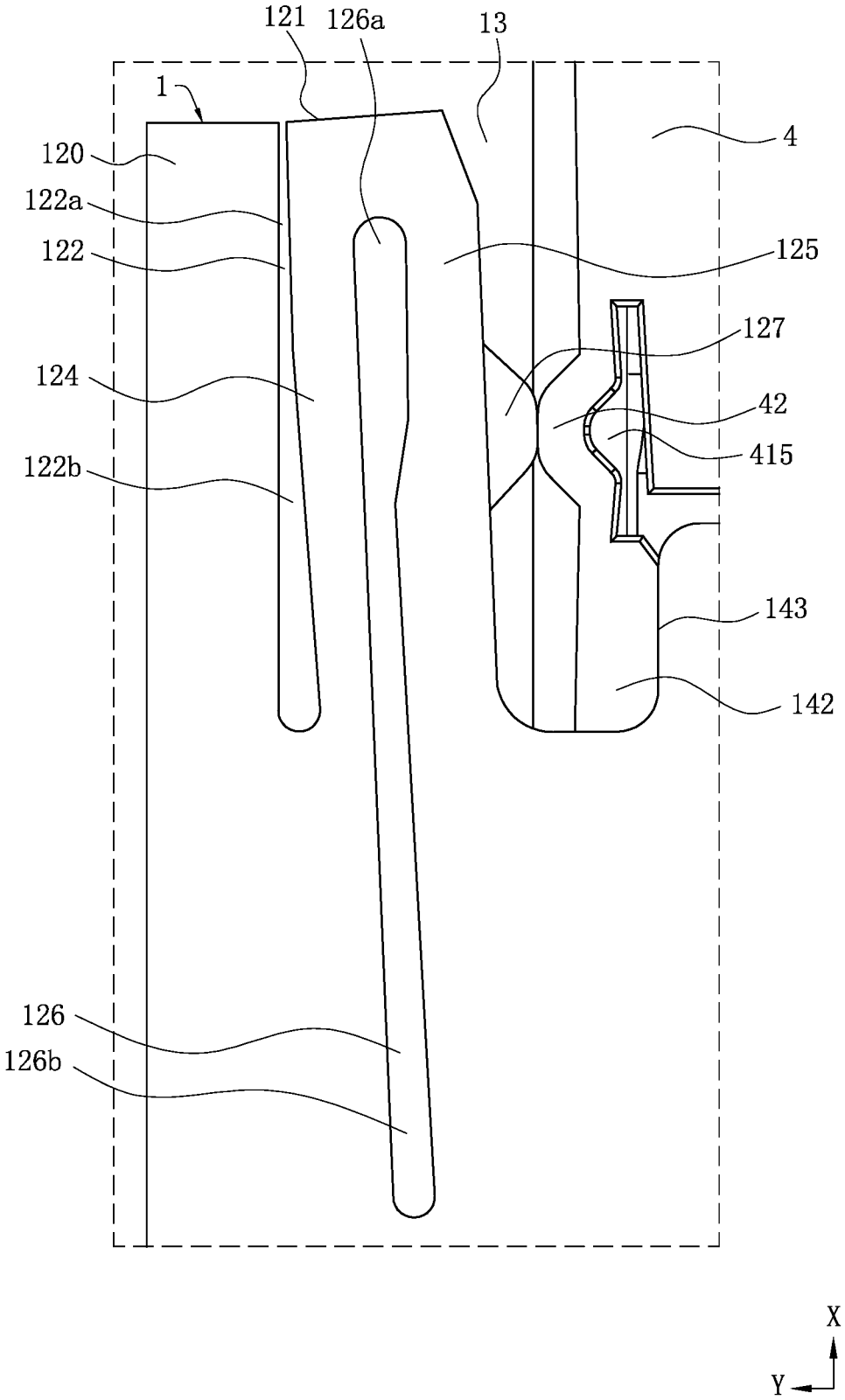
FIG. 6 is a schematic view of the electrical connector and the mating connector in FIG. 5 prior to completion of mating.
Figure 7:
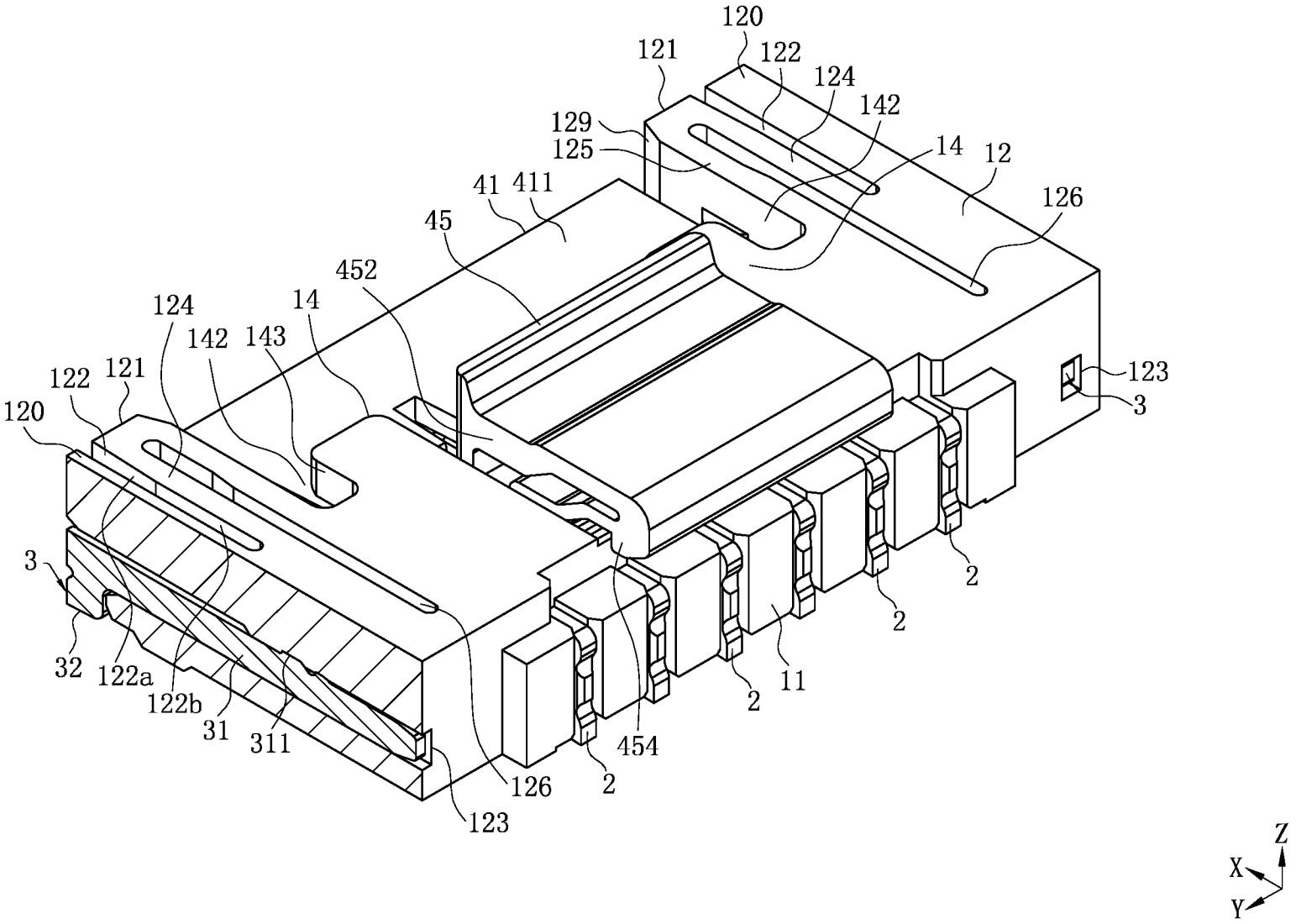
FIG. 7 is a perspective view of FIG. 2 sectioned along a line A-A.

As shown in FIG. 2, FIG. 3 and FIG. 6, the two fixing members 3 are fixed to the fixing slots 123 of the two side walls 12. That is, each fixing member 3 is correspondingly fixed to one of the fixing slots 123. The fixing members 3 protrude backward to pass beyond the front end surface of the rear wall 11. A side of each fixing member 3 facing the mating space 13 in the left-right direction is exposed to the corresponding opening slot 122. Each fixing member 3 is provided with a retaining portion 31 extending in the front-rear direction and a mounting portion 32 exposed downward to a bottom surface of the corresponding extending arm 120. The retaining portion 31 is located behind the mounting portion 32. The retaining portion 31 is provided with a plurality of barbs 311, and the barbs 311 interfere with the corresponding side wall 12 behind the second slot 122*b*. The mounting portion 32 is located in front of the corresponding buckling portion 127, and the mounting portion 32 is soldered downward to the circuit board 300 (also referring to FIG. 9) to fix the electrical connector 100.

As shown in FIG. 1 and FIG. 9, the mating connector 200 includes an insulating body 4 and a plurality of mating terminals 5 accommodated in the insulating body 4. In other embodiments, it is possible to provide only one mating terminal 5.

Figure 8:
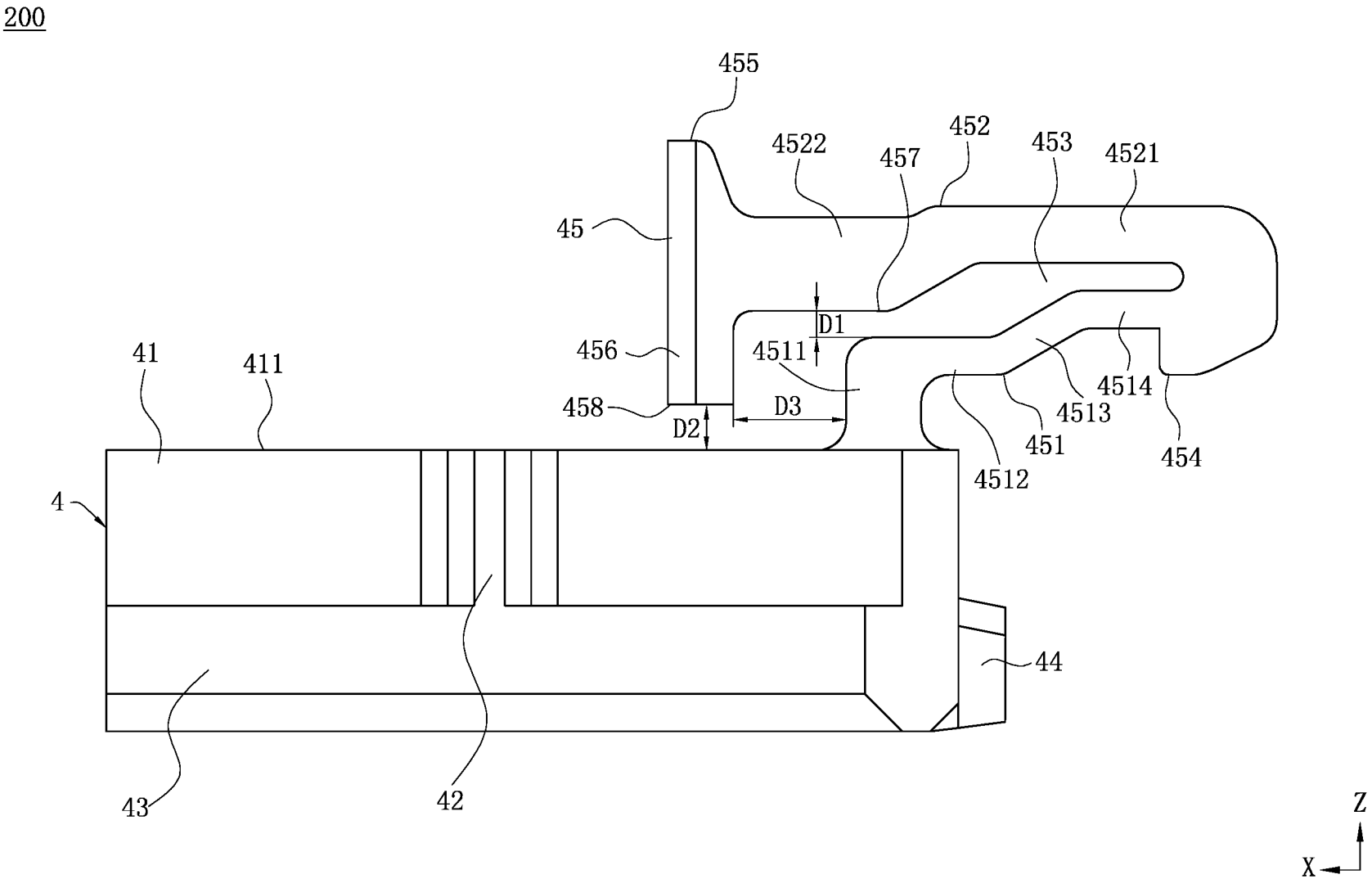
FIG. 8 is a side view of the mating connector in FIG. 2.

As shown in FIG. 1, FIG. 4 and FIG. 8, the insulating body 4 includes a main body portion 41, two clamping portions 42 and two guiding portions 43 respectively located at a left side and a right side of the main body portion 41, a plurality of positioning protruding portion 44 protruding backward from the main body portion 41, and a locking arm 45 extending upward from the main body portion 41.

As shown in FIG. 1, FIG. 4 and FIG. 9, the main body portion 41 is inserted backward into the mating space 13. The main body portion 41 is provided with a top surface 411 in the vertical direction and a plurality of accommodating holes 412. Each accommodating hole 412 runs through the main body portion 41 in the front-rear direction. The main body portion 41 is provided with a protruding block 413 protruding upward and corresponding to each accommodating hole 412. The protruding block 413 is located in front of the contact portion 22 of a corresponding conductive terminal 2 to limit the corresponding conductive terminal 2 from being excessively inserted forward into the corresponding accommodating hole 412. The main body portion 41 is provided with a plurality of through holes 414 running through the top surface 411 but not running through the bottom surface of the main body portion 41, and two reserved slots 415. The through holes 414 one-to-one correspond and are in communication with the accommodating holes 412. The two reserved slots 415 are provided at a left side and a right side of the accommodating holes 412, and each reserved slot 415 and the adjacent through hole 414 are provided to be staggered in the front-rear direction and in communication with each other. In this embodiment, the through holes 414 are in communication with each other along the left-right direction.

As shown in FIG. 1, FIG. 4 and FIG. 5, the clamping portions 42 and the guiding portions 43 are formed by laterally protruding from the main body portion 41 in the left-right direction. At a same side of the main body portion 41, the guiding portion 43 is located below the corresponding clamping portion 42 and is connected to the corresponding clamping portion 42 in the vertical direction, and the guiding portion 43 extends forward to the front end surface of the main body portion 41 and extends backward to the back end surface of the main body portion 41. A certain distance exists between the clamping portion 42 and each of the front end surface and the back end surface of the main body portion 41, and a distance between the clamping portion 42 and the front end surface of the main body portion 41 is less than a distance between the clamping portion 42 and the back end surface of the main body portion 41. The clamping portions 42 and the corresponding buckling portions 127 are buckled to each other to lock the electrical connector 100 and the mating connector 200. Each clamping portion 42 is located behind the corresponding buckling portion 127, and is exposed upward to the corresponding groove 142. Each guiding portion 43 is located below the corresponding clamping portion 42 to suppress the mating connector 200 from excessively moving upward. Each clamping portion 42 is provided to correspond to one of the reserved slots 415 in the left-right direction, and the reserved slots 415 provide deformation spaces for the corresponding clamping portions 42.

As shown in FIG. 4, FIG. 5 and FIG. 6, in the process for each clamping portion 42 and the corresponding buckling portion 127 to be buckled to each other, the elastic arm 121 deviates toward the extending arm 120. The opening slot 122 provides the deformation space for the first arm 124, and the through slot 126 provides the deformation space for the second arm 125, such that the elastic arm 121 has a longer arm, elasticity becomes better, and the usage life is increased. Each clamping portion 42 deforms toward the corresponding reserved slot 415.

As shown in FIG. 1 and FIG. 3, the positioning protruding portions 44 are formed by protruding backward from the back end surface of the main body portion 41. In this embodiment, the quantity of the positioning protruding portions 44 corresponds to the quantity of the positioning slots 112, which is two. Each positioning protruding portion 44 is inserted backward into a corresponding positioning slot 112 to position the mating connector 200 at a location relative to the electrical connector 100.

As shown in FIG. 1, FIG. 8 and FIG. 9, the locking arm 45 protrudes backward into the recess 141, and is located above the rear wall 11. The locking arm 45 is provided with a first elastic arm 451 formed by extending upward and backward from the top surface 411 of the main body portion 41, and a second elastic arm 452 formed by extending forward from the first elastic arm 451. The second elastic arm 452 is located above the first elastic arm 451, and a separation slot 453 is formed between the first elastic arm 451 and the second elastic arm 452. The locking arm 45 has a locking portion 454 provided on the first elastic arm 451, a pressing portion 455 provided on the second elastic arm 452, a protrusion portion 456, a first stopping portion 457 and a second stopping portion 458.

As shown in FIG. 1, FIG. 8 and FIG. 9, the first elastic arm 451 is provided with a supporting portion 4511, a horizontal portion 4512, a bending portion 4513 and a connecting portion 4514. The supporting portion 4511 is formed by extending vertically upward from the top surface 411. The horizontal portion 4512 is formed by extending horizontally backward from the supporting portion 4511, and the bending portion 4513 is formed by extending backward and obliquely upward from the horizontal portion 4512. The connecting portion 4514 extends between the bending portion 4513 and the locking portion 454. The bending portion 4513 allows the connecting portion 4514 to be higher than the supporting portion 4511. The locking portion 454 is formed by protruding downward from the connecting portion 4514. When the pressing portion 455 is pressed downward, the first stopping portion 457 abuts the supporting portion 4511.

As shown in FIG. 1, FIG. 8 and FIG. 9, the locking portion 454 of the first elastic arm 451 facing downward is used to lock the corresponding clip portion 15. The locking portion 454 passes backward beyond the back end surface of the main body portion 41, and is provided to be higher than the top surface 411 of the main body portion 41 in the vertical direction.

As shown in FIG. 1, FIG. 8 and FIG. 9, the second elastic arm 452 includes a first portion 4521 connected to the back end of the first elastic arm 451 and a second portion 4522 formed by extending forward from the first portion 4521. A front end surface of the second portion 4522 is located behind the corresponding through hole 414. A top surface of the second portion 4522 is lower than a top surface of the first portion 4521, and a bottom surface of the second portion 4522 is lower than a bottom surface of the first portion 4521. A connecting location of the first portion 4521 and the first elastic arm 451 passes backward beyond the back end surface of the main body portion 41. The pressing portion 455 is formed by protruding upward from a top surface of a front end of the second portion 4522, and the pressing portion 455 is located in front of the first stopping portion 457. The protrusion portion 456 is formed by protruding downward from a bottom surface of the front end of the second portion 4522. The first stopping portion 457 is formed on a bottom surface of the back end of the second portion 4522, and the second stopping portion 458 is formed on a bottom end of the protrusion portion 456. The first stopping portion 457 is located in front of the locking portion 454, and the second stopping portion 458 is located in front of the first stopping portion 457. The second stopping portion 458 and the pressing portion 455 are provided to align vertically. The locking portion 454 and the second stopping portion 458 are both located below the first stopping portion 457. A distance between the first stopping portion 457 and the first elastic arm 451 in the vertical direction is defined as a first distance D1, a distance between the second stopping portion 458 and the top surface 411 of the main body portion 41 in the vertical direction is defined as a second distance D2, and a distance between the second stopping portion 458 and the first elastic arm 451 in the front-rear direction is defined as a third distance D3. The first distance D1 is less than the second distance D2, and the first distance D1 is less than the third distance D3.

Figure 10:
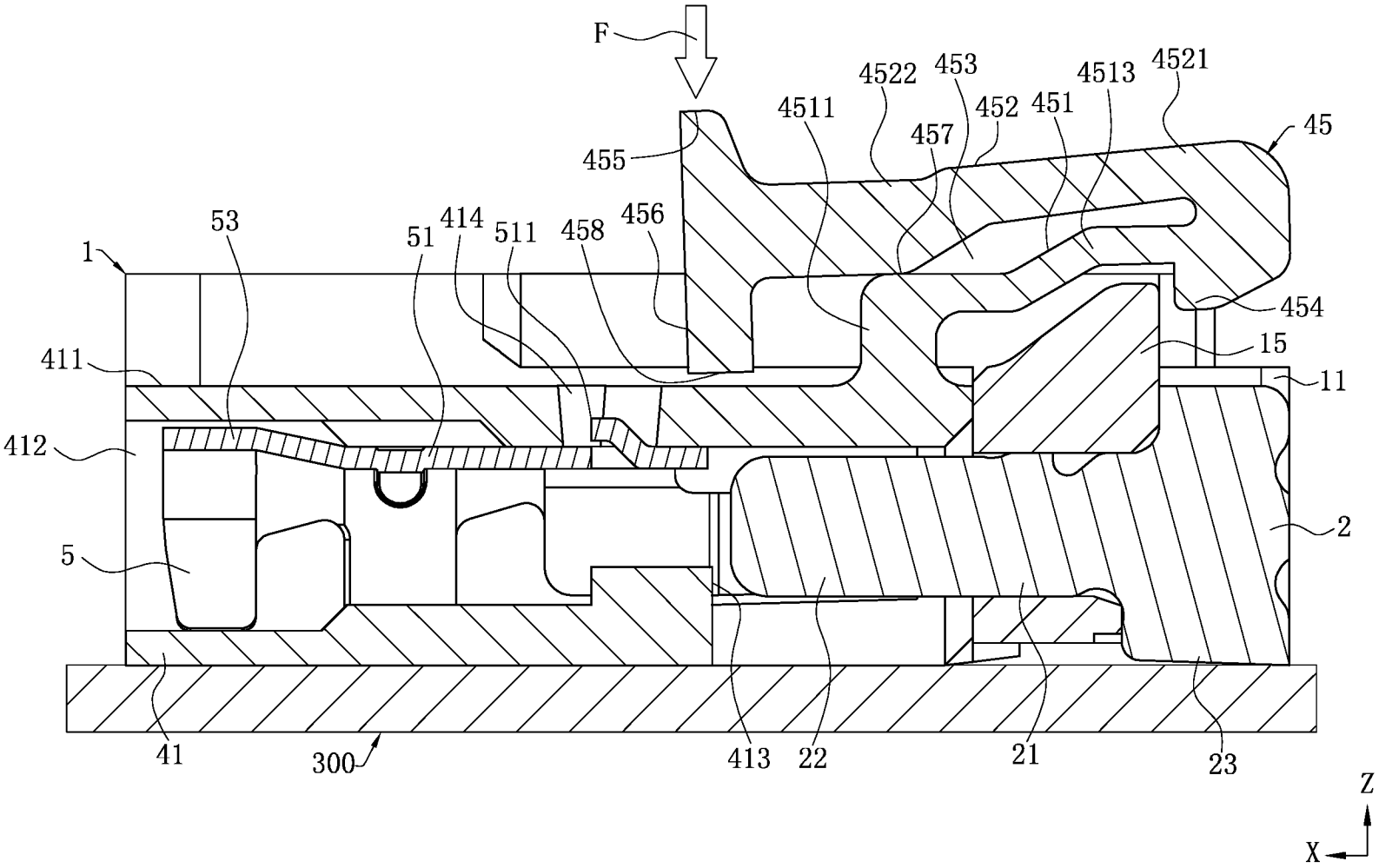
FIG. 10 is a schematic view of the mating connector and the electrical connector in FIG. 9 in a process of detaching from each other.
Figure 11:
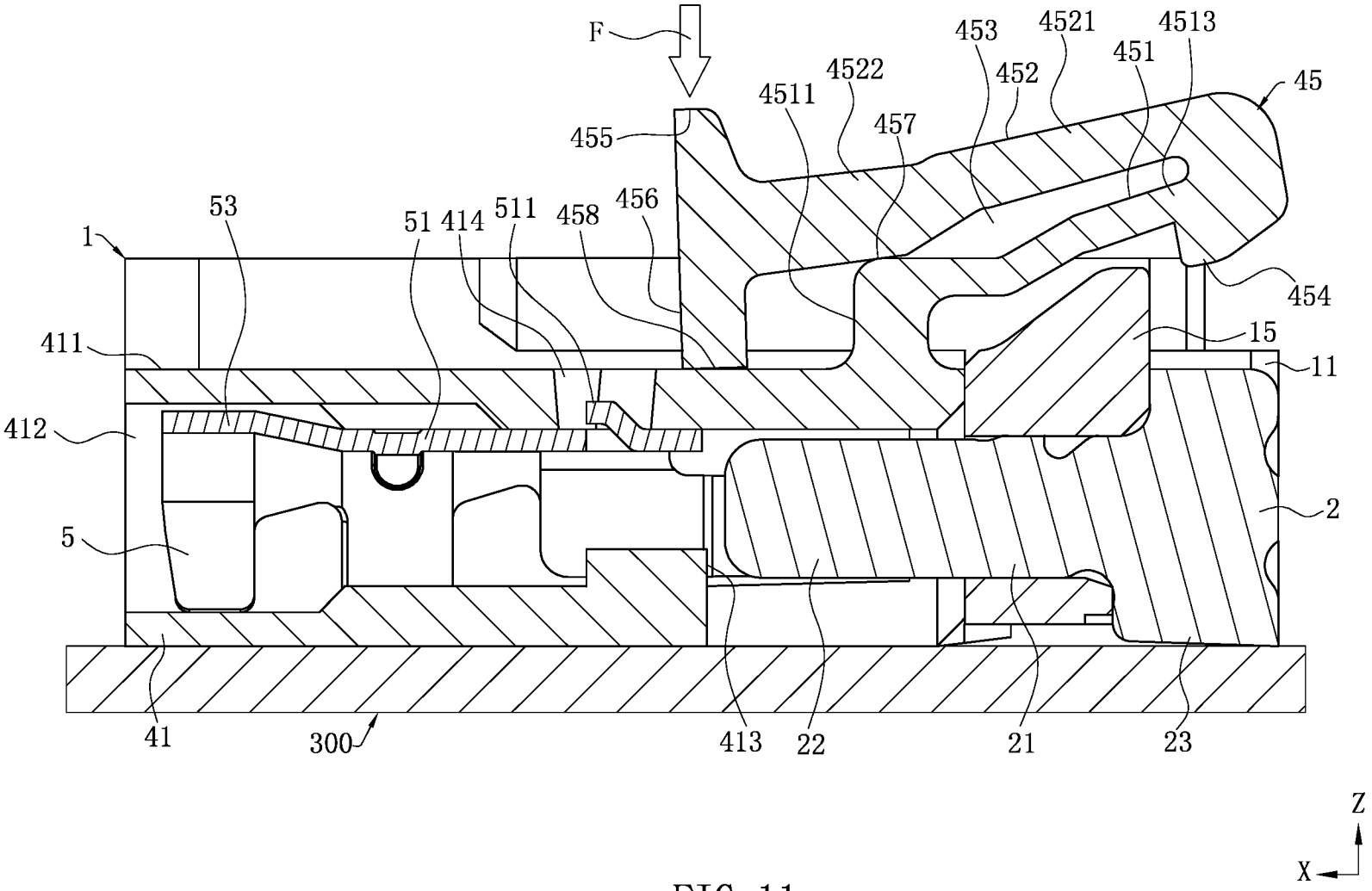
FIG. 11 is a schematic view of the mating connector and the electrical connector in FIG. 9 after detaching from each other.

As shown in FIG. 9, FIG. 10 and FIG. 11, when an acting force F is provided to press the pressing portion 455 downward, the locking portion 454 moves upward, and the first stopping portion 457 downward abuts the first elastic arm 451 prior to the second stopping portion 458 downward abutting the top surface 411 of the main body portion 41. After the first stopping portion 457 downward abuts the first elastic arm 451, the acting force F is continuously provided to press the pressing portion 455 downward, such that after the locking portion 454 continues moving upward, the locking portion 454 and the clip portion 15 detach from each other. The second stopping portion 458 downward abuts the top surface 411 of the main body portion 41 to suppress the second elastic arm 452 from being excessively pressed downward, and to prevent the locking arm 45 from breaking from the main body portion 41.

As shown in FIG. 1 and FIG. 9, the mating terminals 5 are formed by punching a metal plate. The mating terminals 5 are one-to-one correspondingly accommodated in the accommodating holes 412. Each mating terminal 5 is provided with a base portion 51 accommodated in the corresponding accommodating hole 412, a mating portion 52 formed by extending backward from the base portion 51, and a cable connecting portion 53 formed by extending forward from the base portion 51. The base portion 51 is provided with a blocking portion 511 extending upward. The blocking portion 511 is formed by tearing from a plate surface of the base portion 51, and the blocking portion 511 protrudes into the corresponding through hole 414 to prevent the mating terminal 5 from retreating from the corresponding accommodating hole 412. The mating portion 52 is provided with two mating elastic sheets 521 extending backward, and the two mating elastic sheets 521 are used to clamp the contact portion 22 in the left-right direction, forming electrical connection between the two components. The cable connecting portion 53 is used to be connected to the cable (not shown).

FIG. 12 to FIG. 21 show an electrical connector 100 and a connector assembly having the electrical connector 100 according to a second embodiment of the present invention, in which identical structures are not hereinafter elaborated. This embodiment is different from the first embodiment in that: the insulating seat 1 is provided with two protruding portions 144 located at the left side and the right side of the recess 141. Each protruding portion 144 is formed by protruding upward from the top surface of the top wall 14. Each protruding portion 144 is provided to be adjacent to the corresponding groove 142, and is located closer to the recess 141 relative to the corresponding groove 142. A clip portion 15 is formed by protruding from each protruding portion 144 toward the recess 141 in the left-right direction. A bottom surface of the clip portion 15 is flush with the top surface of the top wall 14, and a top surface of the clip portion 15 is higher than the top wall 14. Each clip portion 15 is provided with a guiding chamfer facing downward, which is defined as a first guiding chamfer 151. The first guiding chamfer 151 is provided obliquely backward and downward from a front end surface of the corresponding clip portion 15.

Figure 17:
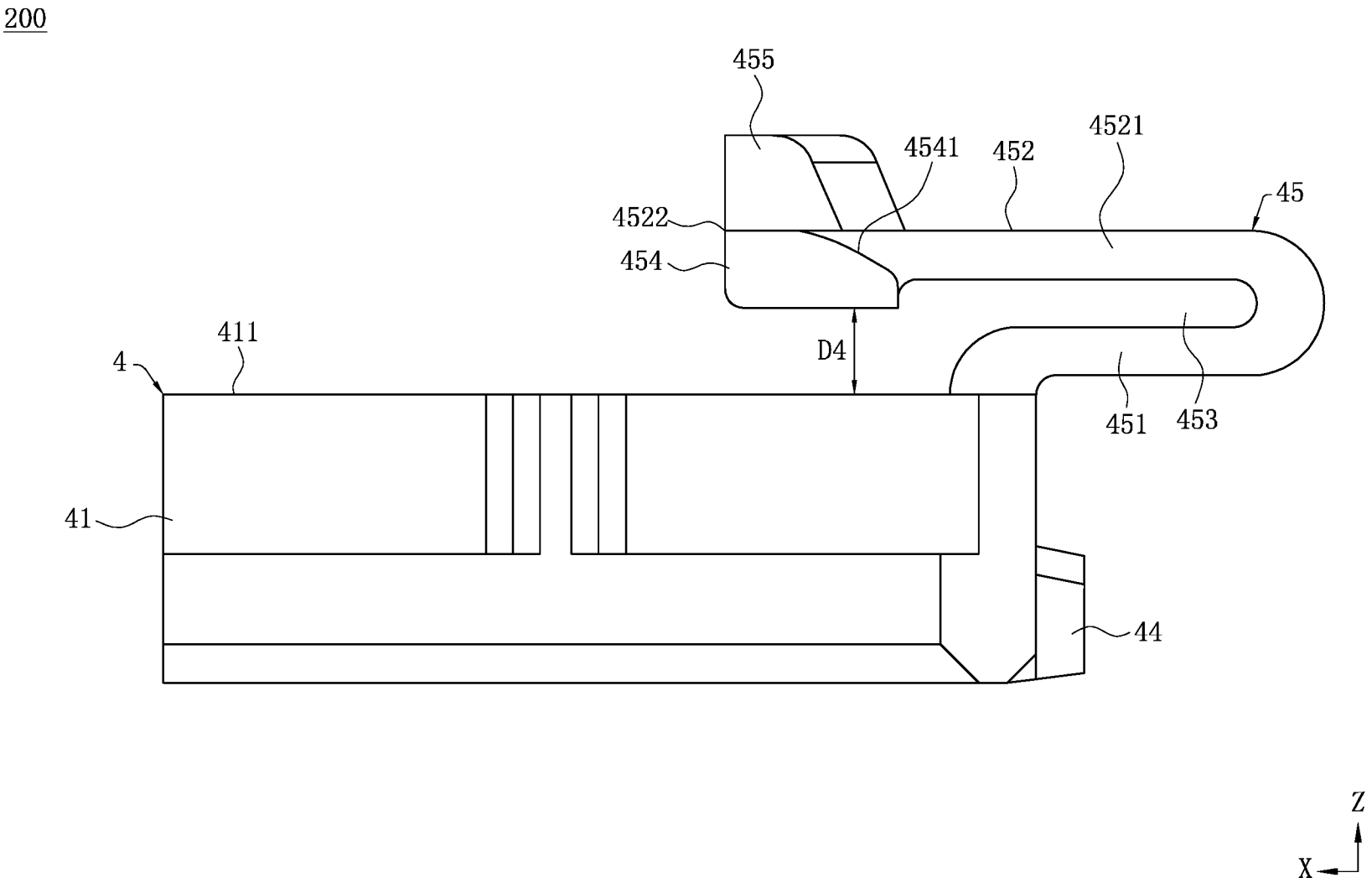
FIG. 17 is a side view of the mating connector in FIG. 13.
Figure 19:
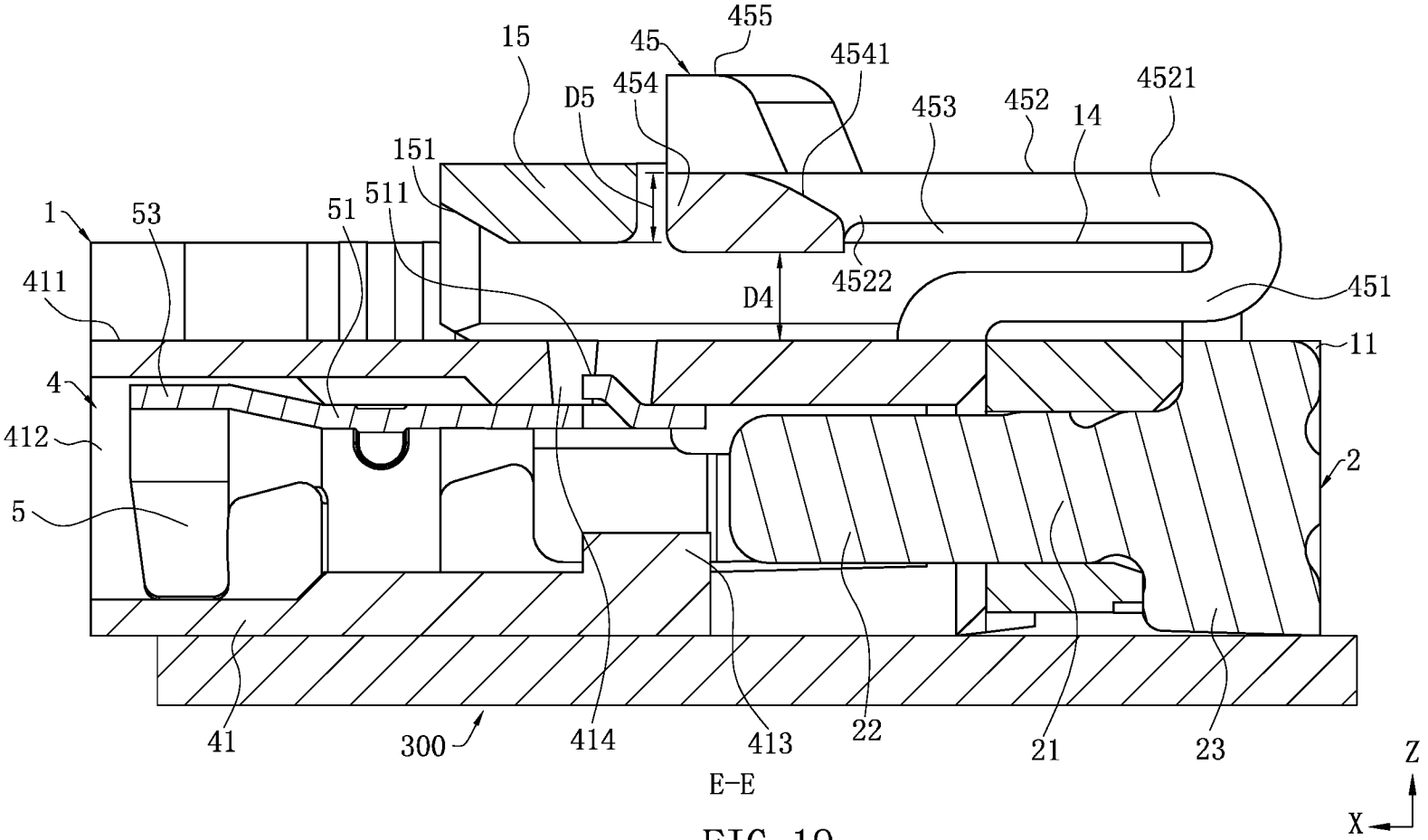
FIG. 19 is a sectional view of the connector assembly and the circuit board in FIG. 18 sectioned along a line E-E.

As shown in FIG. 12, FIG. 17 and FIG. 19, the locking arm 45 includes the first elastic arm 451, the second elastic arm 452, the pressing portion 455 formed by protruding upward from the top surface of the second elastic arm 452, and two locking portions 454 respectively formed by laterally protruding from a left side and a right side of the second elastic arm 452. The first elastic arm 451 and the second elastic arm 452 are provided in parallel in the vertical direction.

As shown in FIG. 12, FIG. 17 and FIG. 19, the first elastic arm 451 is formed by extending upward and then horizontally backward from the top surface 411 of the main body portion 41. A top surface of the first portion 4521 and a top surface of the second portion 4522 are flush. A portion of the second elastic arm 452 passing forward beyond the first elastic arm 451 is defined as the second portion 4522. The pressing portion 455 is formed by protruding upward from the top surface of the front end of the second portion 4522. In the vertical direction, a distance between the second portion 4522 and the top surface 411 of the main body portion 41 is defined as the fourth distance D4, and the fourth distance D4 is greater than a distance between the first portion 4521 and the first elastic arm 451.

Figure 14:
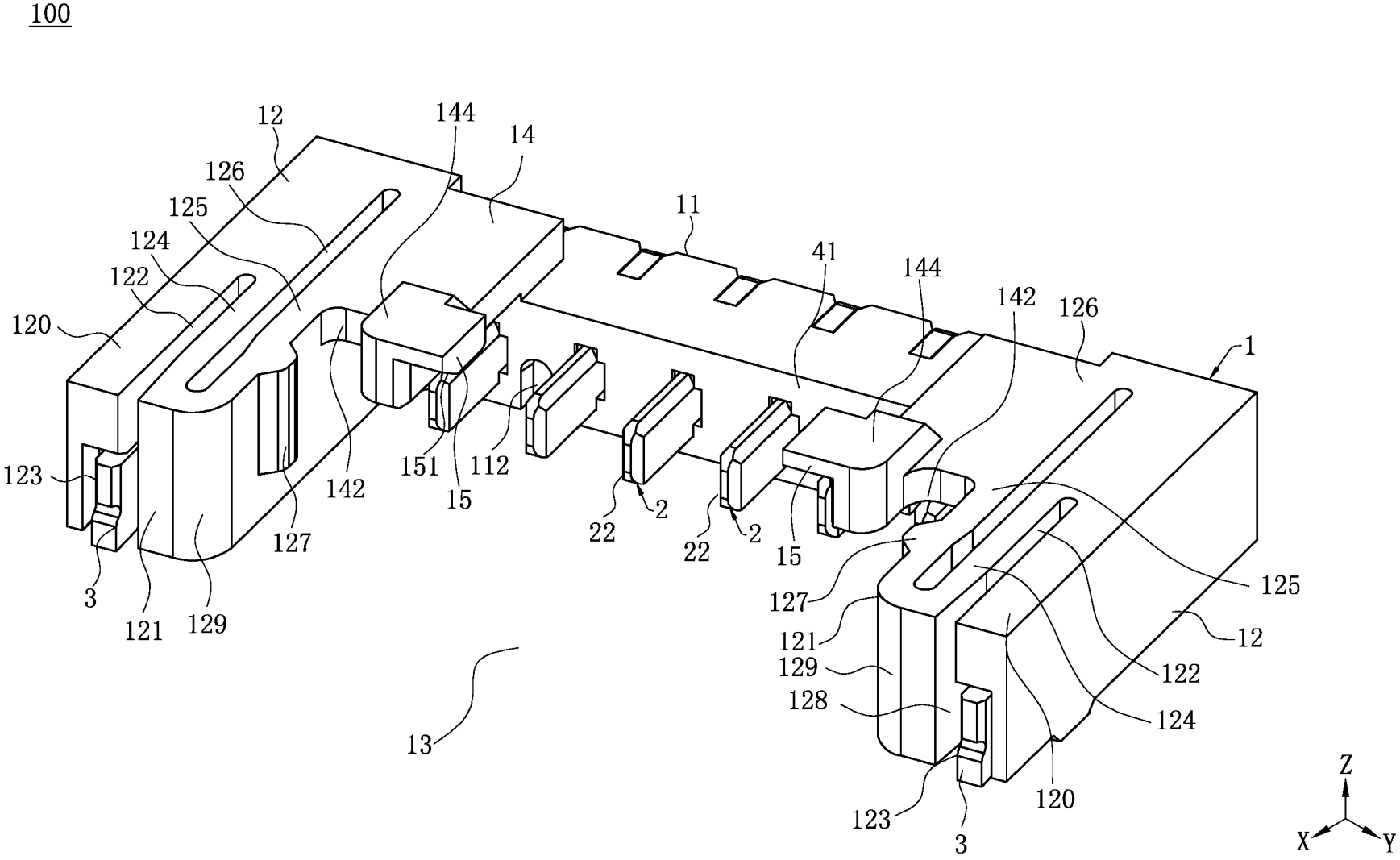
FIG. 14 is a perspective view of the electrical connector in FIG. 13 from another viewing angle.
Figure 15:
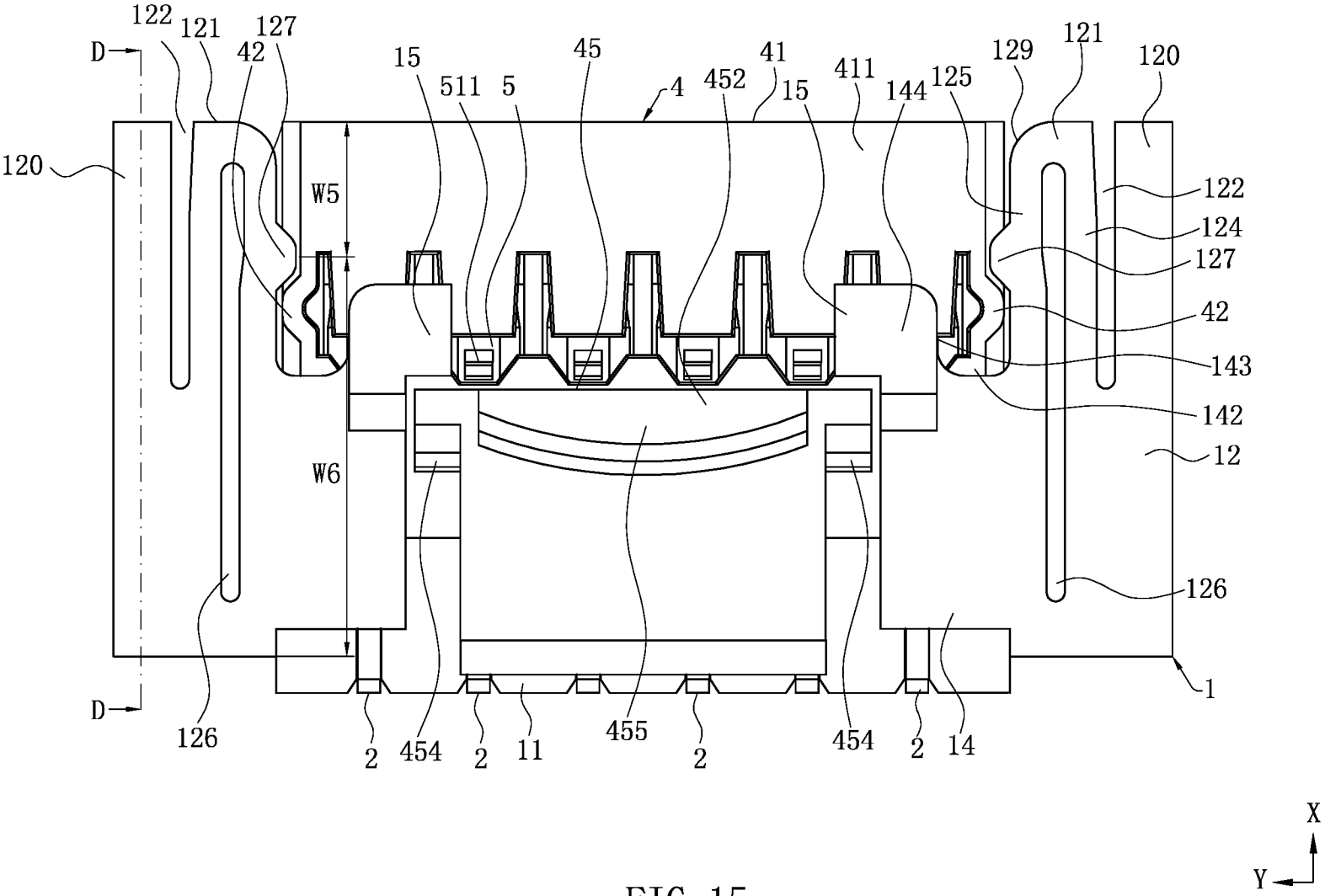
FIG. 15 is a top view of FIG. 13.
Figure 16:
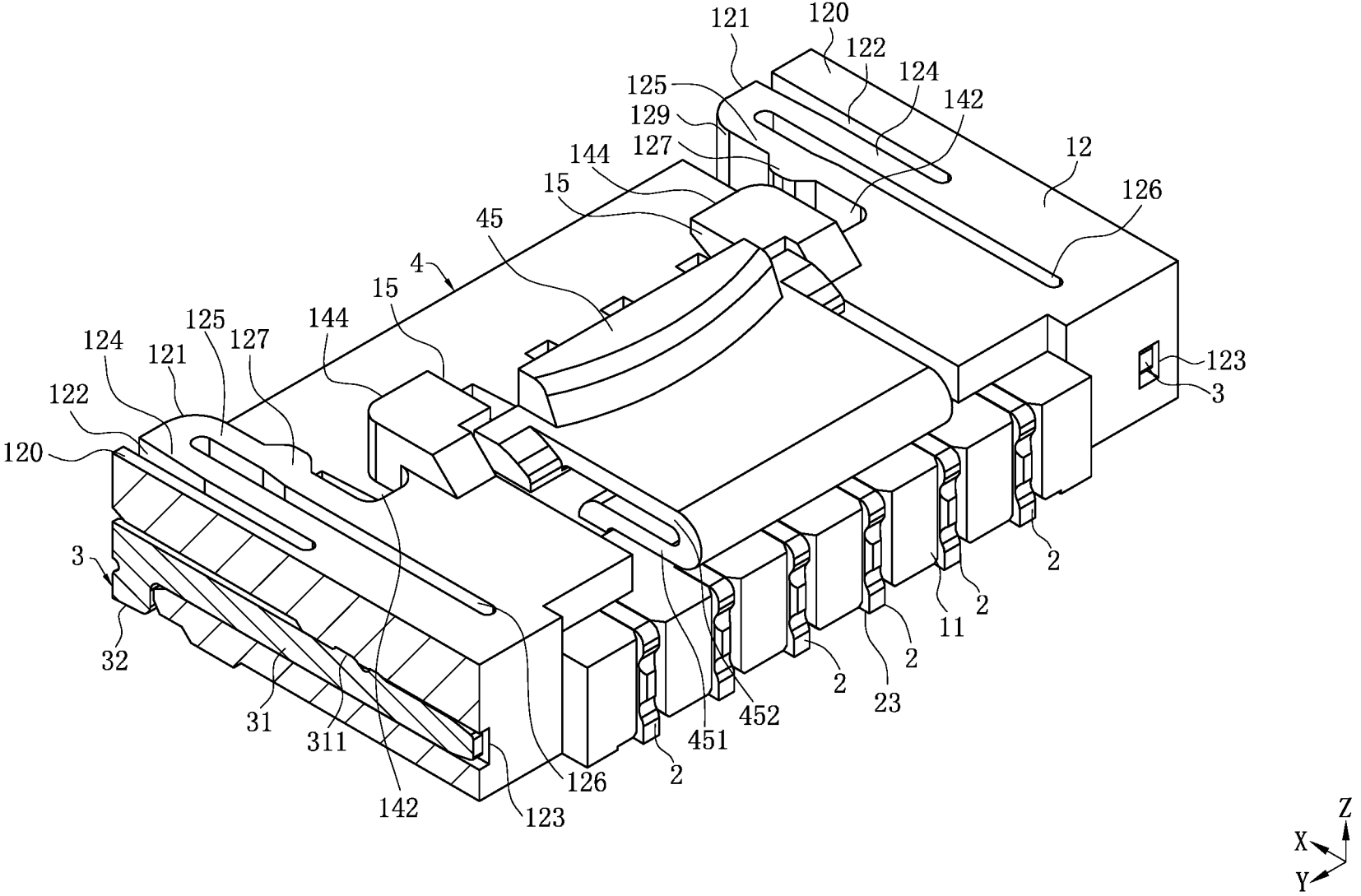
FIG. 16 is a perspective view of FIG. 13 sectioned along a line D-D.

As shown in FIG. 14, FIG. 15 and FIG. 19, the locking portions 454 are respectively formed by laterally protruding from the left side and the right side of the second portion 4522. The pressing portion 455 is located between the two locking portions 454, and is aligned with the two locking portions 454 in the left-right direction. A back end surface of each locking portion 454 is located in front of the corresponding first elastic arm 451. A bottom surface of each clip portion 15 and the top surface of the top wall 14 are located on a same horizontal plane in the vertical direction. The top surface of each locking portion 454 is not higher than the top surface of the second portion 4522. In this embodiment, the top surface of each locking portion 454 is flush with the top surface of the second portion 4522. The pressing portion 455, the two locking portions 454 and the front end surface of the second elastic arm 452 are flush, and are all located behind the corresponding through hole 414.

Figure 18:
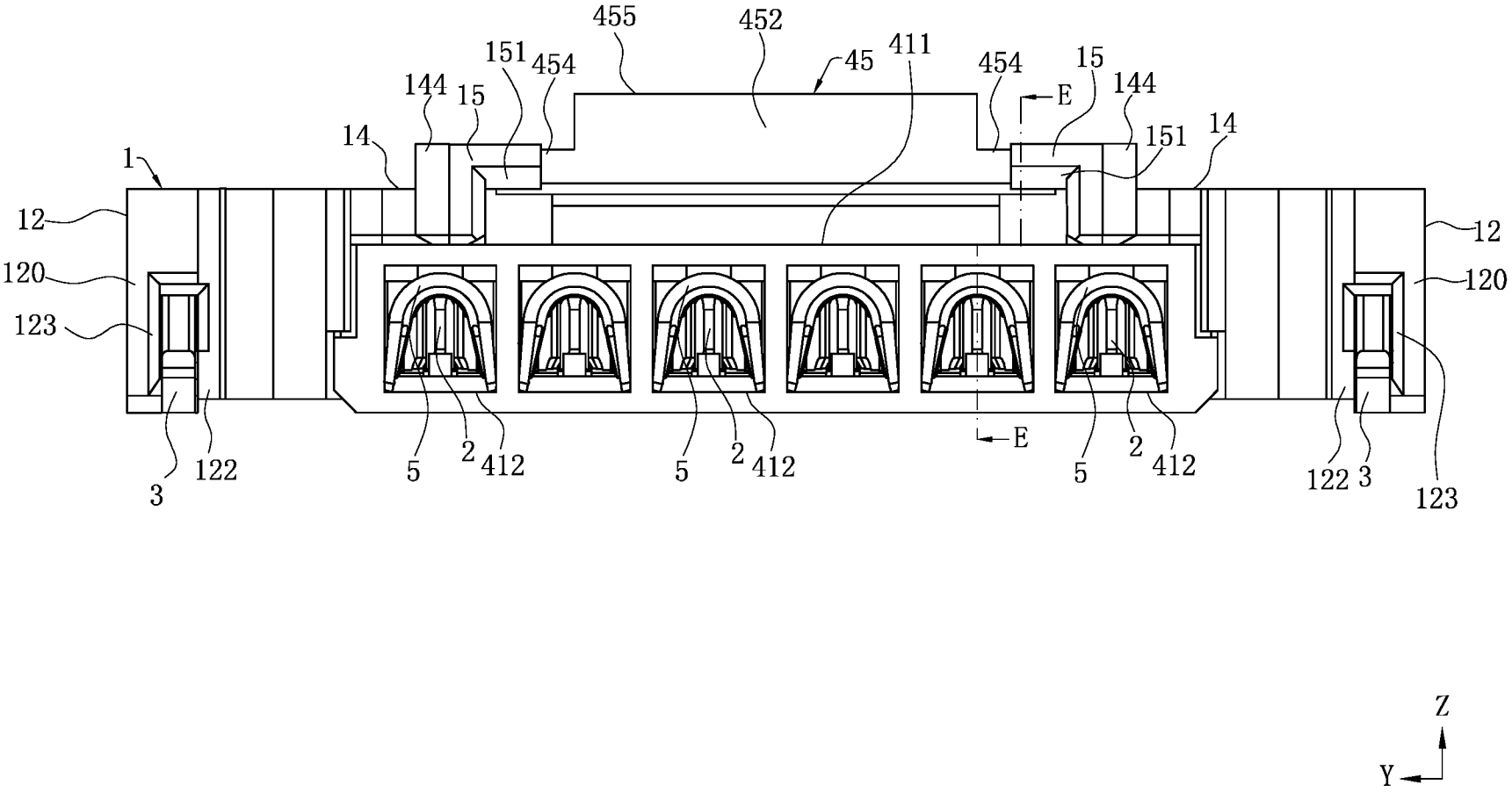
FIG. 18 is a front view of FIG. 13.

As shown in FIG. 18 and FIG. 19, the top surface of each locking portion 454 is lower than the top surface of the corresponding clip portion 15. A distance between the top surface of each locking portion 454 and the bottom surface of the corresponding clip portion 15 is defined as a fifth distance D5, and the fifth distance D5 is less than the fourth distance D4. The top surface of the pressing portion 455 is higher than the top surface of the corresponding clip portion 15.

Figure 20:
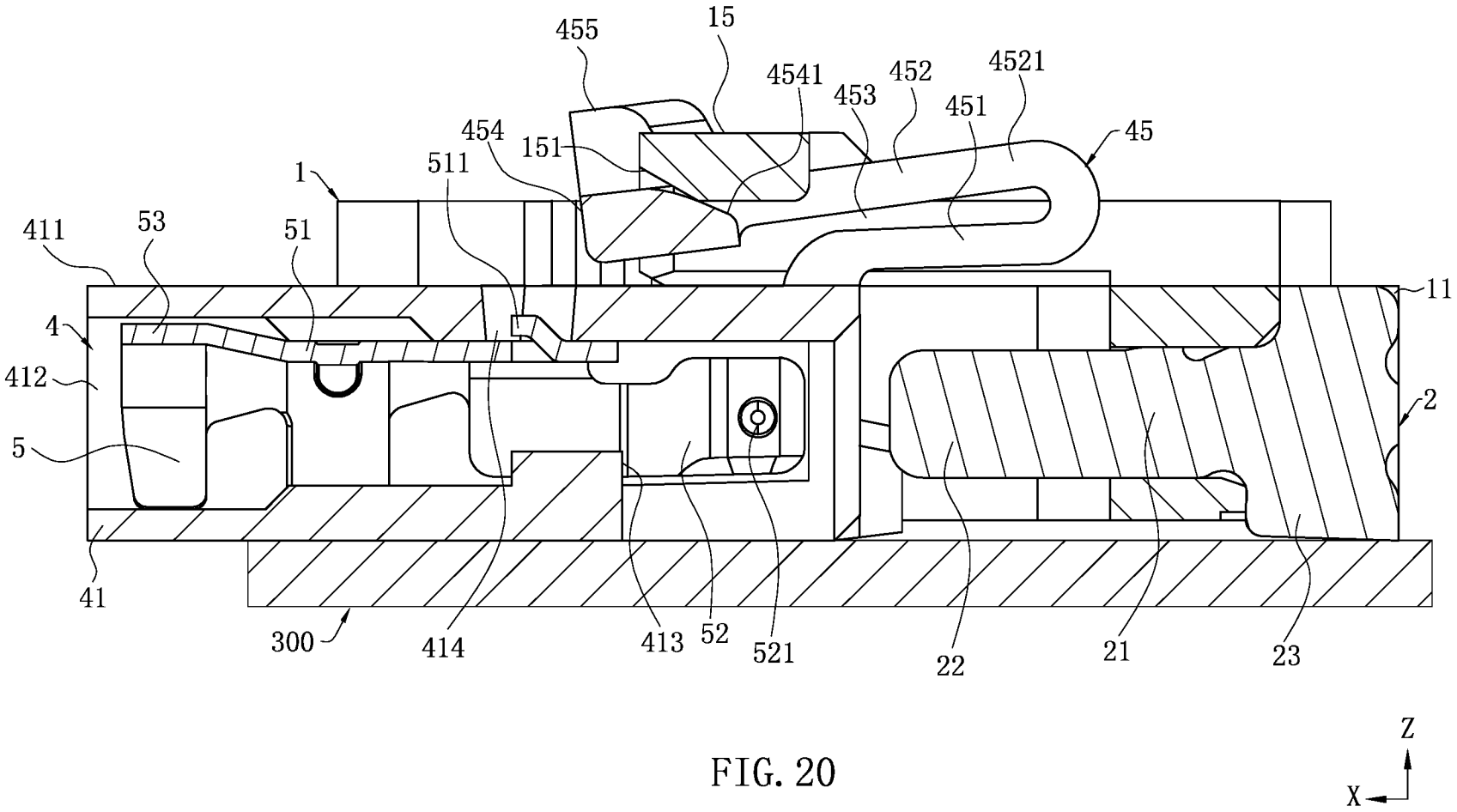
FIG. 20 is a schematic view of the mating connector in FIG. 19 in a process of being inserted into the electrical connector but the two are not clamped together.

As shown in FIG. 19 and FIG. 20, each locking portion 454 is provided with a guiding chamfer facing upward, which is defined as a second guiding chamfer 4541. The second guiding chamfer 4541 is provided obliquely forward and upward from the back end surface of the corresponding locking portion 454. A back end of the second guiding chamfer 4541 is located in front of the pressing portion 455. The second guiding chamfer 4541 is guided by the first guiding chamfer 151, such that the corresponding locking portion 454 moves to be behind the corresponding clip portion 15.

Figure 21:
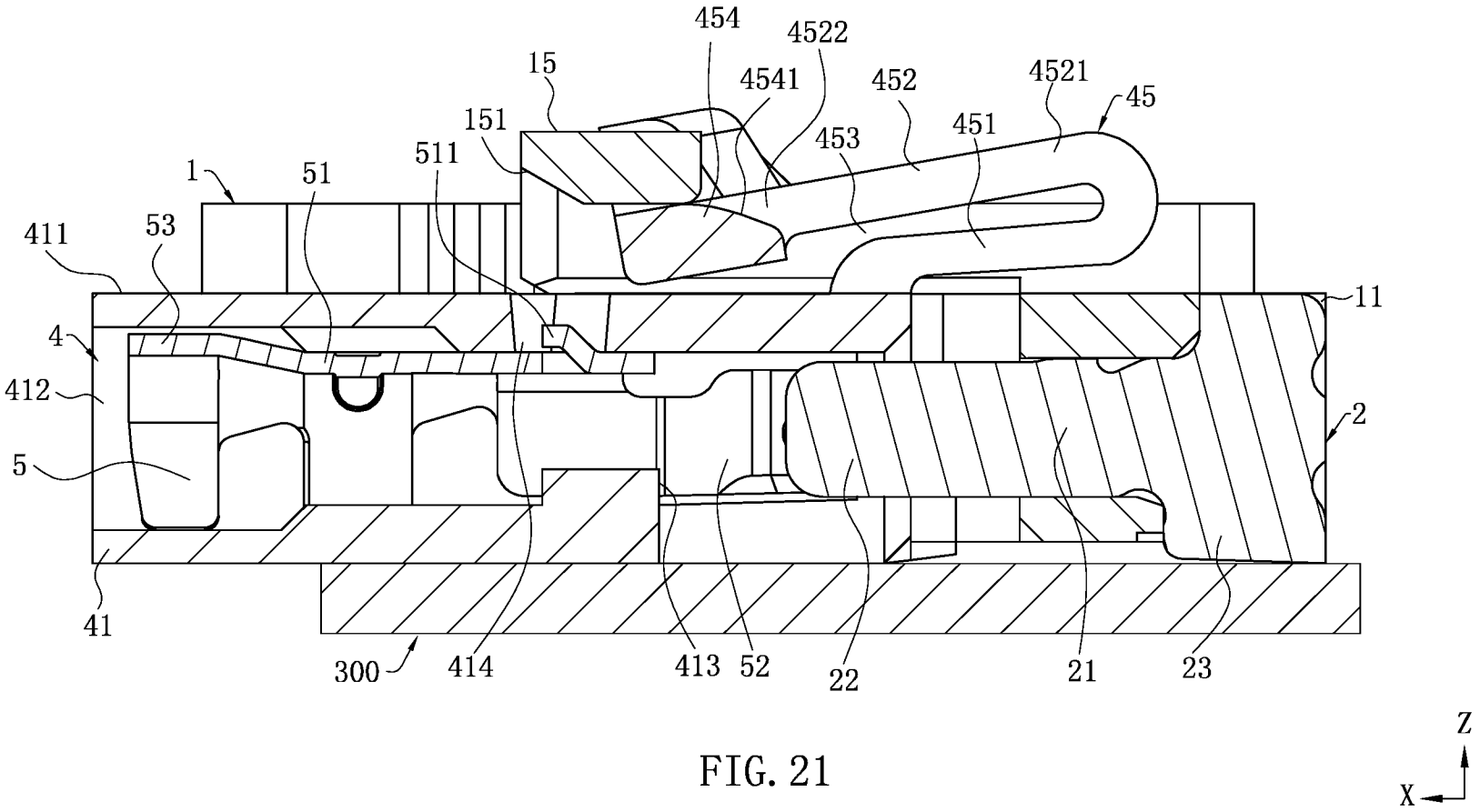
FIG. 21 is a schematic view of the mating connector further inserting into the electrical connector in FIG. 20 but the two are not clamped together.

As shown in FIG. 19, FIG. 20 and FIG. 21, in the process of the mating connector 200 to be inserted backward into the electrical connector 100, the second guiding chamfer 4541 is guided by the first guiding chamfer 151, and the locking portion 454 moves from the location below the corresponding clip portion 15 to be behind the corresponding clip portion 15, and the two are locked together, thus facilitating the locking of the mating connector 200 and the electrical connector 100. When the locking portion 454 and the corresponding clip portion 15 detach from each other, the pressing portion 455 is pressed downward, such that the second elastic arm 452 moves downward, until the bottom surface of the second portion 4522 abuts the top surface 411 of the main body portion 41. The locking portion 454 moves from the location below the corresponding clip portion 15 to be in front of the corresponding clip portion 15, thus facilitating the detaching of the locking portion 454 and the corresponding clip portion 15.

In sum, the electrical connector and the connector assembly having the same according to certain embodiments of the present invention have the following beneficial effects:

(1) The elastic arm 121 has the first arm 124 extending forward from the extending arm 120 and the second arm 125 bending reversely from the first arm 124 and extending backward. The second arm 125 is backward connected to the rear wall 11. The opening slot 122 is formed between the first arm 124 and the extending arm 120 and runs forward therethrough. The through slot 126 is formed between the second arm 125 and the first arm 124. The buckling portion 127 is formed at a side of the second arm 125 away from the first arm 124, and the buckling portion 127 is provided to correspond to the through slot 126 and the opening slot 122 in the left-right direction. By the n-shaped structure of the elastic arm 121, the overall length of the elastic arm 121 for deformation is increased, such that the elasticity of the elastic arm 121 becomes better, thus increasing the insertion number of the electrical connector 100 and the mating connector 200, satisfying the usage requirement, increasing the usage life of the elastic arm 121, and saving the machining cost.

(2) The opening slot 122 includes the first slot 122*a* and the second slot 122*b* connected to the back end of the first slot 122*a*. The first slot 122*a* runs forward through the corresponding side wall 12. A width W1 of the front end of the first slot 122*a* in the left-right direction is greater than a width W2 of the back end of the first slot 122*a* in the left-right direction, thus providing sufficient reserved space for the elastic arm 121 to deform in the left-right direction, and preventing the first arm 124 from colliding the extending arm 120 and resulting in damage to the insulating seat 1.

(3) Each extending arm 120 is fixed with one of the fixing members 3. Each fixing member 3 is provided with the retaining portion 31 and the mounting portion 32. The retaining portion 31 is fixed with interference to the corresponding side wall 12 at a location behind the opening slot 122, such that the corresponding fixing member 3 avoids the opening slot 122 and is fixed to the corresponding side wall 12, and the corresponding side wall 12 is not damaged due to the interference force provided by the fixing member 3. The mounting portion 32 is located in front of the buckling portion 127. The soldering portion 23 of each conductive terminal 2 is exposed to the rear wall 11 and is soldered downward to the circuit board 300. The mounting portion 32 is used to be mounted on the circuit board 300, such that the front end and the back end of the electrical connector 100 are simultaneously on the circuit board 300.

(4) The insulating seat 1 further includes the top wall 14 connected to the rear wall 11, and the top wall 14 is located above the mating space 13. The two grooves 142 are backward concavely provided on the left side and the right side of the front end of the top wall 14 respectively. Each groove 142 is provided to be adjacent to the corresponding second arm 125. The back end of each groove 142 is located behind the corresponding buckling portion 127, thus providing sufficient space for forming the buckling portion 127. Each clamping portion 42 is exposed to the corresponding groove 142, which is convenient for detecting whether the buckling portion 127 and the clamping portion 42 are buckled in position, thus preventing the two components from being not buckled.

(5) The locking arm 45 is provided with the first elastic arm 451 formed by extending upward and backward from the top surface 411 of the main body portion 41, and the second elastic arm 452 formed by extending forward from the first elastic arm 451. The second elastic arm 452 is located above the first elastic arm 451, and the front end of the second elastic arm 452 passes forward beyond the first elastic arm 451. A separation slot 453 is formed between the first elastic arm 451 and the second elastic arm 452, thus increasing the overall arm length of the locking arm 45, providing better elasticity, such that the locking arm 45 does not easily fatigue, and the usage life is increased. The first elastic arm 451 is provided with the locking portion 454 facing downward to lock with the corresponding clip portion 15 of the electrical connector 100. The second elastic arm 452 is provided with the first stopping portion 457 located in front of the locking portion 454 and the second stopping portion 458 located in front of the first stopping portion 457. The acting force F is provided to press the pressing portion 455 on the second elastic arm 452 downward. The first stopping portion 457 downward abuts the first elastic arm 451 prior to the second stopping portion 458 downward abutting the top surface 411 of the main body portion 41. After the first stopping portion 457 downward abuts the first elastic arm 451, the acting force F is continuously provided to press the pressing portion 455 downward, such that after the locking portion 454 continues moving upward, the locking portion 454 and the clip portion 15 detach from each other. The second stopping portion 458 downward abuts the top surface 411 of the main body portion 41 to suppress the second elastic arm 452 from being excessively pressed downward, such that a moving supporting point is formed on the first elastic arm 451 for the locking portion 454 to move upward, which does not generate an excessive stress to the location of the first elastic arm 451 connected to the main body portion 41. Instead, the stress is distributed on the first elastic arm 451 and the second elastic arm 452. Using the principle of leverage, it allows the locking portion 454 to move upward, thereby facilitating the detachment of the locking portion 454 and the corresponding clip portion 15, increasing the arm length of the locking arm 45, ensuring the locking arm 45 to occupy a smaller space, and satisfying the practical requirements.

(6) The blocking portion 511 of each mating terminal 5 protrudes into the corresponding through hole 414, thus preventing the mating terminal 5 from retreating from the corresponding accommodating hole 412. The front end surface of the second arm 125 is located behind the corresponding through hole 414, which is conducive for a sliding block forming the through hole 414 to be ejected from the mold.

(7) Each protruding block 413 is provided to correspond to one accommodating hole 412. The protruding block 413 is located in front of the corresponding conductive terminal 2 to limit the corresponding conductive terminal 2 from being excessively inserted forward into the corresponding accommodating hole 412, thus ensuring the stable conductive connection of the conductive terminal 2 and the corresponding mating terminal 5.

(8) The guiding portions 43 are provided at the left side and the right side of the insulating body 4 and located below the corresponding clamping portion 42. Each guiding portion 43 passes forward and backward beyond the corresponding clamping portion 42. In the process of mating the electrical connector 100 and the mating connector 200, each guiding portion 43 is located below the corresponding buckling portion 127 to guide the insulating body 4 to be inserted backward into the mating space 13, and to prevent the mating connector 200 from moving upward excessively in the mounting process, which is conducive for accurately matching of the two components.

(9) The two locking portions 454 are respectively formed by laterally protruding from a left side and a right side of the front end of the locking arm 45. Each locking portion 454 is located behind the corresponding clip portion 15 such that the two are locked together. The pressing portion 455 is formed by protruding upward from the front end of the locking arm 45. The pressing portion 455 is located between the two locking portions 454, and is aligned with the two locking portions 454 in the left-right direction, such that in the case where the downward movement of the pressing portion 455 is small, the locking portion 454 and the corresponding clip portion 15 may detach from each other, and the deformation amount of the locking arm 45 is small, preventing the locking arm 45 from breaking due to being excessively pressed.

(10) The top surface of the pressing portion 455 is higher than the top surface of each clip portion 15, allowing an operator to press the pressing portion 455 downward.

(11) Each clip portion 15 is provided with the first guiding chamfer 151 facing downward, and the first guiding chamfer 151 is provided obliquely backward and downward from the front end surface of the corresponding clip portion 15. Each locking portion 454 is provided with a second guiding chamfer 4541 facing upward, and the second guiding chamfer 4541 is provided obliquely forward and upward from the back end surface of the corresponding locking portion 454. The second guiding chamfer 4541 is guided by the first guiding chamfer 151, such that the corresponding locking portion 454 moves to be behind the corresponding clip portion 15.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating seat, comprising a rear wall and two side walls located at a left side and a right side of the rear wall, wherein the rear wall and the two side walls surroundingly form a mating space, each of the two side walls comprises an extending arm and an elastic arm provided close to the mating space relative to the extending arm, the elastic arm has a first arm formed by extending forward from the extending arm and a second arm formed by bending reversely from the first arm and extending backward, the second arm is backward connected to the rear wall, an opening slot is formed between the first arm and the extending arm and runs forward therethrough, a through slot is formed between the second arm and the first arm, a buckling portion is formed at a side of the second arm away from the first arm, and the buckling portion is provided to correspond to the through slot and the opening slot in a left-right direction; and at least one conductive terminal, provided in the insulating seat, wherein the conductive terminal has a contact portion exposed to the mating space, wherein the through slot comprises a front through slot and a rear through slot, a width of the front through slot in a left-right direction is greater than a width of the rear through slot in the left-right direction, and the buckling portion is provided to correspond to the front through slot in the left-right direction.

2. The electrical connector according to claim 1, wherein the through slot extends backward to pass beyond the opening slot.

3. The electrical connector according to claim 1, wherein a back end of the opening slot is located in front of the rear wall.

4. The electrical connector according to claim 1, wherein a distance between the buckling portion and a front end surface of a corresponding side wall of the two side walls is less than a distance between the buckling portion and a front end surface of the rear wall.

5. The electrical connector according to claim 1, wherein the opening slot comprises a first slot and a second slot connected to a back end of the first slot, the first slot runs forward through a corresponding side wall of the two side walls, and a width of a front end of the first slot in a left-right direction is greater than a width of the back end of the first slot in the left-right direction.

6. The electrical connector according to claim 1, wherein the second arm is provided with a guiding chamfer connected to a front end surface of the second arm and facing the mating space, the first arm is provided with an oblique surface connected to a front end surface of the first arm and facing the opening slot, and a back end of the oblique surface passes backward beyond the guiding chamfer.

7. The electrical connector according to claim 1, wherein the extending arm of each of the two side walls is fixed with a fixing member, the fixing member is configured to be fixed to a circuit board, and a side of the fixing member is exposed to the opening slot of a corresponding side wall of the two side walls.

8. The electrical connector according to claim 1, wherein the extending arm of each of the two side walls is fixed with a fixing member, the fixing member is provided with a retaining portion and a mounting portion, the retaining portion is fixed with interference to a corresponding side wall of the two side walls at a location behind the opening slot, and the mounting portion is configured to be mounted on a circuit board.

9. The electrical connector according to claim 8, wherein the fixing member protrudes backward to pass beyond a front end surface of the rear wall.

10. An electrical connector, comprising:

an insulating seat, comprising a rear wall and two side walls located at a left side and a right side of the rear wall, wherein the rear wall and the two side walls surroundingly form a mating space, each of the two side walls comprises an extending arm and an elastic arm provided close to the mating space relative to the extending arm, the elastic arm has a first arm formed by extending forward from the extending arm and a second arm formed by bending reversely from the first arm and extending backward, the second arm is backward connected to the rear wall, an opening slot is formed between the first arm and the extending arm and runs forward therethrough, a through slot is formed between the second arm and the first arm, a buckling portion is formed at a side of the second arm away from the first arm, and the buckling portion is provided to correspond to the through slot and the opening slot in a left-right direction; and at least one conductive terminal, provided in the insulating seat, wherein the conductive terminal has a contact portion exposed to the mating space, wherein the insulating seat further comprises a top wall connected to the rear wall, the top wall is located above the mating space, two grooves are backward concavely provided on a left side and a right side of a front end of the top wall respectively, each of the two grooves is provided to be adjacent to the second arm of a corresponding side wall of the two side walls, and a back end of each of the two grooves is located behind the buckling portion of the corresponding side wall.

11. The electrical connector according to claim 10, wherein each of the two grooves has a side edge provided at an interval with the second arm of the corresponding side wall in a left-right direction, the buckling portion is formed by protruding from the second arm toward the mating space, and the buckling portion does not pass beyond the side edge of a corresponding groove of the two grooves in the left-right direction.

12. The electrical connector according to claim 10, wherein the opening slot comprises a first slot and a second slot connected to a back end of the first slot, the first slot runs forward through a corresponding side wall of the two side walls, and a width of a front end of the first slot in a left-right direction is greater than a width of the back end of the first slot in the left-right direction.

13. The electrical connector according to claim 10, wherein the extending arm of each of the two side walls is fixed with a fixing member, the fixing member is provided with a retaining portion and a mounting portion, the retaining portion is fixed with interference to a corresponding side wall of the two side walls at a location behind the opening slot, and the mounting portion is configured to be mounted on a circuit board.

14. The electrical connector according to claim 13, wherein the fixing member protrudes backward to pass beyond a front end surface of the rear wall.

15. A connector assembly, comprising:

an electrical connector, comprising an insulating seat and at least one conductive terminal provided in the insulating seat, wherein the insulating seat comprises a rear wall and two side walls located at a left side and a right side of the rear wall, the rear wall and the two side walls surroundingly form a mating space, each of the two side walls comprises an extending arm and an elastic arm provided close to the mating space relative to the extending arm, the elastic arm has a first arm extending forward from the extending arm and a second arm bending reversely from the first arm and extending backward, the second arm is backward connected to the rear wall, an opening slot is formed between the first arm and the extending arm and runs forward therethrough, a through slot is formed between the second arm and the first arm, a buckling portion is formed at a side of the second arm away from the first arm, the buckling portion is provided to correspond to the through slot and the opening slot in a left-right direction, and the conductive terminal has a contact portion exposed to the mating space; and a mating connector, inserted backward into the mating space of the electrical connector, wherein the mating connector comprises an insulating body and at least one mating terminal accommodated in the insulating body, two clamping portions are respectively provided at a left side and a right side of the insulating body to correspondingly buckle with the buckling portions provided on the two side walls, and the mating terminal is provided with a mating portion to be conductively connected to the contact portion, wherein two guiding portions are respectively provided at the left side and the right side of the insulating body and located below the two clamping portions correspondingly, the two guiding portions pass forward and backward beyond the two clamping portions correspondingly, and in a process of the electrically connector mating with the mating connector, the guiding portions are located below the two buckling portions and guide the insulating body to be inserted backward into the mating space.

16. The connector assembly according to claim 15, wherein a distance between the buckling portion and a front end surface of a corresponding side wall of the two side walls is less than a distance between the buckling portion and a front end surface of the rear wall.

17. The connector assembly according to claim 15, wherein the opening slot comprises a first slot and a second slot connected to a back end of the first slot, the first slot runs forward through a corresponding side wall of the two side walls, and a width of a front end of the first slot in a left-right direction is greater than a width of the back end of the first slot in the left-right direction.

18. The connector assembly according to claim 15, wherein the extending arm of each of the two side walls is fixed with a fixing member, the fixing member is provided with a retaining portion and a mounting portion, the retaining portion is fixed with interference to a corresponding side wall of the two side walls at a location behind the opening slot, and the mounting portion is configured to be mounted on a circuit board.

19. The connector assembly according to claim 15, wherein the insulating seat further comprises a top wall connected to the rear wall, the top wall is located above the mating space, two grooves are backward concavely provided on a left side and a right side of a front end of the top wall respectively, each of the two grooves is provided to be adjacent to the second arm of a corresponding side wall of the two side walls, each of the clamping portions is located behind the corresponding buckling portion, and each of the clamping portions is exposed to a corresponding groove of the two grooves.

20. The connector assembly according to claim 15, wherein the insulating body is provided with at least one accommodating hole correspondingly accommodating the at least one mating terminal and at least one protruding block corresponding to the at least one accommodating hole, the protruding block is located in front of a corresponding conductive terminal of the at least one conductive terminal to limit the corresponding conductive terminal from being excessively inserted forward into a corresponding one of the at least one accommodating hole.

21. The connector assembly according to claim 15, wherein:

the insulating body is provided with a main body portion and a locking arm, and the two clamping portions are respectively provided at a left side and a right side of the main body portion;

the locking arm is provided with a first elastic arm formed by extending upward and backward from a top surface of the main body portion and a second elastic arm formed by extending forward from the first elastic arm, the second elastic arm is located above the first elastic arm, a front end of the second elastic arm passes forward beyond the first elastic arm, and a separation slot is formed between the first elastic arm and the second elastic arm;

the first elastic arm is provided with a locking portion facing downward to lock a clip portion of the electrical connector;

the second elastic arm is provided with a first stopping portion located in front of the locking portion and a second stopping portion located in front of the first stopping portion;

the locking arm is provided with a pressing portion on the second arm;

when an acting force is provided to press the pressing portion downward, the locking portion moves upward, and the first stopping portion downward abuts the first elastic arm prior to the second stopping portion downward abutting the top surface of the main body portion;

after the first stopping portion downward abuts the first elastic arm, the acting force is continuously provided to press the pressing portion downward, such that the locking portion continues moving upward, and the locking portion and the clip portion detach from each other, and the second stopping portion downward abuts the top surface of the main body portion to suppress the second elastic arm from being excessively pressed downward.

22. The connector assembly according to claim 21, wherein the locking portion and the second stopping portion are both located below the first stopping portion.

23. The connector assembly according to claim 21, wherein the pressing portion is formed by protruding upward from a front end of the second elastic arm, a protrusion portion is formed by protruding downward from the second elastic arm, the second stopping portion is formed at a bottom end of the protrusion portion, and the pressing portion and the second stopping portion are provided to align vertically.

24. The connector assembly according to claim 21, wherein the main body portion is provided with at least accommodating hole accommodating the at least one mating terminal and at least one through hole running through the top surface of the main body portion, the at least one accommodating hole runs through the main body portion in a front-rear direction, the through hole is in communication with a corresponding one of the at least one accommodating hole, the mating terminal is provided with a blocking portion, the blocking portion protrudes into the through hole to prevent the mating terminal from retreating from the accommodating hole, and a front end surface of the second arm is located behind the through hole.

25. The connector assembly according to claim 24, wherein two reserved slots are provided at the left side and the right side of the main body portion and correspond to the two clamping portions, the reserved slots provide deformation spaces for the corresponding clamping portions, and each of the reserved slots is in communication with a corresponding one of the at least one through hole.

26. The connector assembly according to claim 15, wherein the insulating seat is provided with a top wall formed by protruding forward from the rear wall, the top wall is located above the mating space, a recess is backward concavely provided on a front end of the top wall, the top wall is provided with two clip portions located at a left side and a right side of the recess, the insulating body is provided with a main body portion and a locking arm formed by extending from a top surface of the main body portion, the locking arm is accommodated in the recess, two locking portions are formed by respectively protruding from a left side and a right side of a front end of the locking arm, the two locking portions are respectively located behind the two clip portions correspondingly such that the locking portions and the clip portions are correspondingly locked to each other, a pressing portion is formed by protruding upward from the front end of the locking arm, and the pressing portion is located between the two locking portions and aligned to the two locking portions in the left-right direction.

27. The connector assembly according to claim 26, wherein a top surface of the pressing portion is higher than a top surface of each of the two clip portions.

28. The connector assembly according to claim 26, wherein each of the clip portions is provided with a first guiding chamfer facing downward, the first guiding chamfer is provided obliquely backward and downward from a front end surface of each of the clip portions, each of the locking portions is provided with a second guiding chamfer facing upward, the second guiding chamfer is provided obliquely forward and upward from a back end surface of each of the locking portions, the second guiding chamfer is guided by the first guiding chamfer, such that each of the locking portions moves to be behind a corresponding one of the clip portions.

29. The connector assembly according to claim 26, wherein the locking arm comprises a first elastic arm formed by extending upward and backward from a top surface of the main body portion and a second elastic arm formed by extending forward from the first elastic arm, the second elastic arm is located above the first elastic arm, the locking portions are formed by protruding from a front end of the second elastic arm in the left-right direction, and the locking portions are located in front of the first arm.

30. The connector assembly according to claim 29, wherein a top surface of each of the locking portions is provided to be flush with a top surface of the second elastic arm.

* * * * *